US006071228A

United States Patent [19]

Speraw et al.

[11] Patent Number: 6,071,228

[45] Date of Patent: Jun. 6, 2000

[54] PATIENT-SUPPORT ASSEMBLY FOR THERMAL SUPPORT APPARATUS

[75] Inventors: Floyd G. Speraw, Anderson, S.C.; D. Scott Prows, Cincinnati, Ohio

[73] Assignee: Hill-Rom, Inc., Batesville, Ind.

[21] Appl. No.: 08/926,380

[22] Filed: Sep. 9, 1997

[51] Int. Cl.[7] ..... A61G 11/00

[52] U.S. Cl. ..... 600/22

[58] Field of Search ..... 600/21, 22; 5/600–612; 108/1–19; 74/547

[56] References Cited

U.S. PATENT DOCUMENTS

| | | | |
|---|---|---|---|
| 2,187,312 | 1/1940 | Goodlake | 108/7 |
| 3,158,150 | 11/1964 | Croasdaile . | |
| 3,187,744 | 6/1965 | Dorsak et al. . | |
| 3,335,713 | 8/1967 | Grosholz et al. . | |
| 3,821,947 | 7/1974 | Schossow . | |
| 3,858,570 | 1/1975 | Beld et al. . | |
| 4,222,602 | 9/1980 | Kouth | 74/547 X |
| 4,361,137 | 11/1982 | Grosholz . | |
| 4,552,034 | 11/1985 | Bertani et al. | 74/547 |
| 4,628,553 | 12/1986 | Buttitta et al. . | |
| 4,734,945 | 4/1988 | Wright . | |
| 4,750,474 | 6/1988 | Dukhan et al. . | |
| 4,819,282 | 4/1989 | McArthur et al. . | |
| 4,885,918 | 12/1989 | Vaccaro . | |
| 5,162,038 | 11/1992 | Wilker . | |
| 5,244,452 | 9/1993 | Vaccaro et al. . | |
| 5,308,310 | 5/1994 | Roff et al. . | |
| 5,376,761 | 12/1994 | Koch et al. . | |
| 5,453,077 | 9/1995 | Donnelly et al. . | |
| 5,531,663 | 7/1996 | Gloyd et al. . | |
| 5,624,375 | 4/1997 | Dykes et al. . | |

FOREIGN PATENT DOCUMENTS

| | | | |
|---|---|---|---|
| 2061704 | 7/1979 | Germany . | |
| 49-122184 | 11/1974 | Japan . | |
| 405103817 | 4/1993 | Japan | 600/22 |
| WO 97/11664 | 4/1997 | WIPO . | |

OTHER PUBLICATIONS

"The New Isoliette® Infant Incubator Only From Air Shields" product brochure, one page, believed to be published prior to Sep. 8, 1996.

"Stabilet® From Hill–Rom®" Product Brochure, six pages, 1992.

"Stabilet CC™ From Hill–Rom®" Product Brochure, six pages, 1992.

"The Stabilet™ Freestanding Warmer and Clinical Bassinet From Hill–Rom®" Product Brochure, four pages, 1993.

"A Hill–Rom Solution, Stabilet 2000C, Stabilet CC, Stabilet Freestanding Infant Warmer Accessories" Product Brochure, eight pages, 1995.

"Isolette® Infant Incubator . . . The Essence of Incubation", Air–Shields, Inc. Product Brochure, eight pages, 1996.

*Primary Examiner*—Samuel G. Gilbert

*Attorney, Agent, or Firm*—Barnes & Thornburg

[57] ABSTRACT

A patient-support apparatus comprising a base, and a patient-support assembly supported above the base including a patient-support deck having longitudinally spaced-apart ends and an elevation mechanism for moving one of the ends of the patient-support deck relative to the other of the ends and relative to the base. The elevation mechanism including a transversely-extending threaded shaft, a pair of blocks threadedly coupled to the shaft, and a linkage coupled to the pair of blocks and extending upwardly therefrom to support the end of the patient support deck to be moved by the elevation mechanism, the pair of blocks moving transversely in response to rotation of the threaded shaft, and the linkage having horizontally extending pins being configured to move the end of the patient-support deck relative to the base in response to transverse movement of the blocks.

34 Claims, 10 Drawing Sheets

PATIENT-SUPPORT ASSEMBLY FOR THERMAL SUPPORT APPARATUS

BACKGROUND AND SUMMARY OF THE INVENTION

The present invention relates to a patient-support assembly for a patient-support apparatus, and particularly, to a patient-support assembly for a thermal support apparatus such as an infant warming device. More particularly, the present invention relates to a tilting mechanism and an X-ray tray that are included in the patient-support assembly.

Thermal support devices, such as infant warmers and incubators, having a chamber and various systems that maintain the chamber at a controlled temperature and humidity to facilitate the development of a premature infant are known. Conventional thermal support devices include a mattress for supporting the infant in the chamber and devices for adjusting the elevation and inclination of the mattress relative to the rest of the thermal support device. It is desirable for devices that adjust the elevation and inclination of the mattress to do so in a smooth manner. It is also desirable for devices that adjust the elevation and inclination of the mattress to be made from a small number of basic components to minimize cost and to simplify cleaning and service, when needed.

Some conventional thermal support devices include x-ray trays that support cassettes of x-ray film beneath the infant when x-rays are to be taken, thereby eliminating the need to transfer the infant to another support device to have x-rays taken. It is desirable for x-ray trays to be accessible from either side of the thermal support device so that cassettes of x-ray film can be loaded onto the x-ray tray from either side of the thermal support device.

According to the present invention, a patient-support apparatus includes a base and a patient-support assembly supported above the base. The thermal support assembly includes a patient-support deck having longitudinally spaced-apart ends and an elevation mechanism for moving one of the ends of the patient-support deck relative to the other of the ends and relative to the base. In a preferred embodiment, the elevation mechanism includes a transversely-extending threaded shaft, a pair of blocks threadedly coupled to the shaft, and a linkage coupled to the pair of blocks and extending upwardly therefrom to support the end of the patient support deck to be moved by the elevation mechanism. The pair of blocks move transversely in response to rotation of the threaded shaft and the linkage is configured to move the end of the patient-support deck relative to the base in response to transverse movement of the blocks.

In preferred embodiments, the thermal support apparatus includes such an elevation mechanism at each of the ends of the patient-support deck. The elevation mechanisms are independently operable to move the patient-support deck to Trendelenburg and reverse Trendelenburg positions. In addition, the elevation mechanisms are operable to position the patient-support deck in an infinite number of positions between the Trendelenburg and reverse Trendelenburg positions.

A first portion of the threaded shaft of each elevation mechanism is formed to include a right-handed thread and a second portion of the threaded shaft of each elevation mechanism is formed to include a left-handed thread. In addition, each of the blocks of the pair of blocks includes a drive block portion and a nut plate formed to include a first aperture having a right-handed thread and a second aperture having a left-handed thread. The orientation of the nut plates relative to the respective drive block portions depends upon which portion of the threaded shaft the respective block is to be mounted. This "reversible" nut plate arrangement allows the drive blocks and the nut plates to be identically constructed and then assembled together in the appropriate manner.

The linkage of each elevation mechanism includes a first link, a second link, and a deck-engaging link. Each of the first and second links has a lower end that pivotably couples to a respective drive block portion and an upper end that pivotably and slidably couples to the deck-engaging link. The first link is pivotably coupled to the second link in a crossing or "scissors" arrangement. Each deck-engaging link supports the end of the patient-support deck to be moved by the respective elevation mechanism. In addition, each deck-engaging link is formed to include first and second slots and the upper ends of the respective links are coupled to the deck-engaging links at the respective slots. Each elevation mechanism includes an idler arm having an upper end coupled to the respective deck-engaging link and a lower end pivotably coupled to the respective first link to prevent transverse movement of the deck-engaging link relative to the respective first and second links.

Each elevation mechanism includes a pair of knobs and each knob is coupled to an end of the respective threaded shaft. Each knob includes a knob body and a crank handle coupled to the knob. In use, each knob is rotated to make minor adjustments to the elevation mechanism and the crank handle is folded out relative to the knob body to a use position where it is used to quickly rotate the knob body and threaded shaft to make major adjustments to the elevation mechanism. A spring is interposed between each knob and the respective threaded shaft to provide shock absorption therebetween. The springs allow each knob to move transversely inwardly toward the respective shaft if the knob is inadvertently bumped. After a particular knob is bumped, the respective spring biases the knob outwardly back into its normal position.

According to the present invention, the thermal support apparatus includes an x-ray tray coupled to the patient-support deck for sliding movement beneath a mattress carried by the patient-support deck. A link couples the x-ray tray to the patient-support deck. The x-ray tray is movable between a use position underlying the mattress, a first load position in which a portion of the x-ray tray extends beyond a first side of the patient-support deck, and a second load position in which a portion of the x-ray tray extends beyond a second side of the patient-support deck. The patient-support deck is formed to include a first stop adjacent to the first side and a second stop adjacent to the second side. When the x-ray tray is in the first load position, the link engages the first stop and when the x-ray tray is in the second load position, the link engages the second stop.

The patient-support deck includes a slot extending between the first and second stops along a generally bell-shaped path and the x-ray tray is formed to include an aperture. The link is formed to include a downwardly-extending first end disk received in the slot for sliding movement relative to the patient-support deck and an upwardly-extending second end disk received in the aperture for pivoting movement relative to the x-ray tray. The bell-shaped path of the slot causes the link to pivot through approximately one hundred eighty degrees relative to the x-ray tray as the x-ray tray is moved between the first and second load positions. Engagement between the first end disk of the link and the first and second stops prevents the x-ray tray from moving past the respective first and second load positions.

The base of the thermal support apparatus supports a platform tub having an upwardly-facing platform surface and four walls extending upwardly therefrom to define an interior region above the platform surface. The patient-support assembly is supported by the platform surface. When the patient-support deck and x-ray tray are positioned to lie inside the interior region of the platform tub, the x-ray tray is inaccessible. When the patient-support deck and x-ray tray are positioned to lie above the interior region of the platform tub, the x-ray tray is accessible to be moved between the use position and each of the first and second load positions.

Embodiments of the present invention, therefore, comprise a base and a patient-support assembly supported above the base. The patient-support assembly includes a patient-support deck and an elevation mechanism for moving one of the ends of the patient-support deck. The elevation mechanism includes first and second links coupled together at their middle portions, a deck-engaging link coupled to upper ends of the first and second links and arranged to support the end of the patient-support deck, and a driver coupled to lower ends of the first and second links. The driver is operable to move the lower ends of the first and second links toward one another to raise the deck-engaging link and away from one another to lower the deck-engaging link. The deck-engaging link includes an upwardly-facing surface and the patient-support deck includes a downwardly-facing surface that engages the upwardly-facing surface to provide for pivoting and sliding movement of the patient-support deck relative to the deck engaging link. An x-ray tray is coupled to the patient-support deck by a link. The patient-support deck is formed to include first and second stops. When the link engages the first stop the x-ray tray is in a first load position extending beyond a first side of the patient-support deck and when the link engages the second stop the x-ray tray is in a second load position extending beyond a second side of the patient-support deck.

Additional features and advantages of the invention will become apparent to those skilled in the art upon consideration of the following detailed description of a preferred embodiment exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
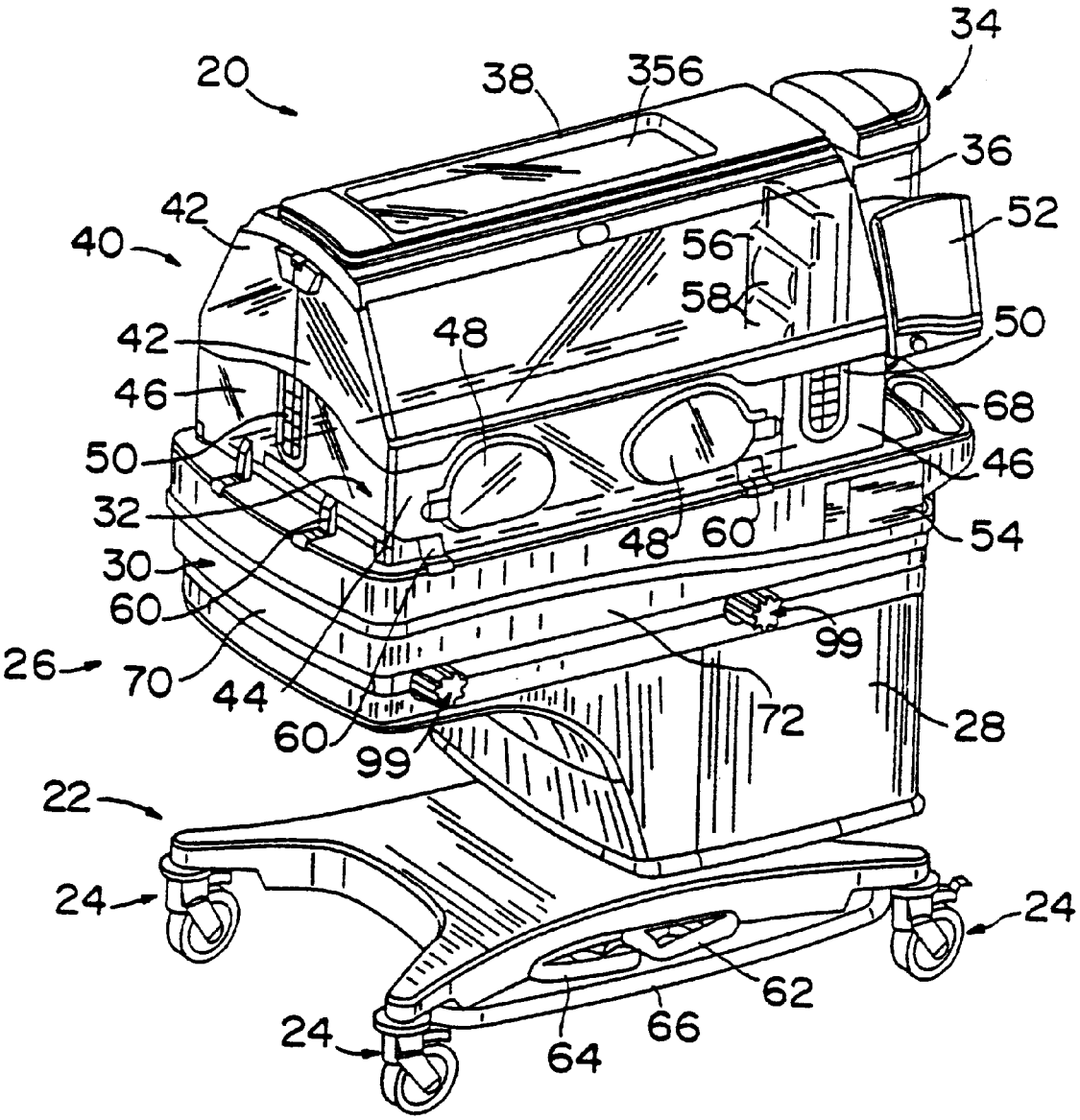
FIG. 1 is a perspective view of a patient-support apparatus according to the present invention showing a base, an infant supporting portion carried above the base, and an isolation chamber above the infant supporting portion and enclosed by an overhead portion of a canopy support arm, a pair of transparent canopy halves, a pair of transparent side guards, and a pair of transparent end guards.

A thermal support apparatus or patient-support apparatus 20, such as an infant warming device or incubator, includes a base 22, a plurality of castors 24 extending downwardly from base 22, and an infant supporting portion or patient support 26 supported above base 22 as shown in FIG. 1. Infant supporting portion 26 includes a pedestal 28 coupled to base 22 for vertical movement, a platform tub 30 supported by pedestal 28, and a patient-support assembly 32 supported by platform tub 30. Patient-support apparatus 20 also includes a canopy support arm 34 including a vertical telescoping arm 36 and a horizontal overhead arm 38. A canopy 40 is coupled to overhead portion 38 and is positioned to lie above platform tub 30. Canopy 40 includes a pair of canopy halves 42 coupled to overhead portion 38 for pivoting movement between a lowered position, shown in FIG. 1, and a raised position (not shown).

A pair of transparent side guards 44 and a pair of transparent end guards 46 extend upwardly from platform tub 30 as shown in FIG. 1. Side guards 44 and end guards 46 cooperate with canopy halves 42 and overhead portion 38 to provide patient-support apparatus 20 with an isolation chamber. Side guards 44 may be formed to include a pair of access ports that are normally closed by access port covers 48. Access port covers 48 can be opened to allow access to a patient, such as an infant, supported by patient-support apparatus 20 within the isolation chamber. Each end guard 46 is formed to include at least one U-shaped window and a pass-through grommet 50 is positioned to lie in each U-shaped window. Wires and tubes (not shown) can be routed into the isolation chamber through pass-through grommets 50.

Patient-support apparatus 20 includes a user interface panel 52 for monitoring various systems that control the temperature and humidity of the isolation chamber and for allowing caregivers to input various control parameters into memory of a control system of patient-support apparatus. Patient-support apparatus 20 also includes a humidifier module 54 that can be filled with water and inserted into a humidifier compartment of platform tub 30. Heated air is blown through humidifier module 54 and directed into the isolation chamber. A tower 56 is positioned to lie in the isolation chamber. Tower 56 supports various sensors 58, such as patient environmental sensors and light and noise sensors, and also provides a return-air path for the air being circulated through the isolation chamber.

Hinges 60 are provided so that side guards 44 and one of end guards 46 can pivot downwardly away from canopy 40 to provide increased access to the infant supported by patient-support apparatus 20. Up and down buttons (not shown) can be pressed to extend and retract vertical telescoping portion 36 of canopy support arm 34, thereby raising and lowering, respectively, overhead portion 38 of canopy support arm 34 and canopy 40. Patient-support apparatus 20 includes an up pedal 62 that can be depressed to raise infant supporting portion 26 relative to base 22 and a down pedal 64 that can be depressed to lower infant supporting portion 26 relative to base 22. Patient-support apparatus 20 includes a side bumper 66 that protects pedals 62, 64 and other components, such as base 22 and pedestal 28, from inadvertent impact. Platform tub 30 is formed to include a handle 68 on each side of canopy support arm 34. Handles 68 can be grasped by a caregiver to maneuver patient-support apparatus 20 during transport.

Other features of patient-support apparatus 20 are discussed in detail in co-pending applications Ser. No. 08/925,981 U.S. Pat. No. 6,022,310 (attorney docket 7175-28091); Ser. No. 08/925,873 (attorney docket 7175-28750) pending; Ser. No. 08/926,383 (attorney docket 7175-28752) pending; and Ser. No. 08/926,381 U.S. Pat. No. 5,971,913 (attorney docket 7175-28855), filed concurrently herewith, all of which are incorporated herein by reference.

Figure 2:
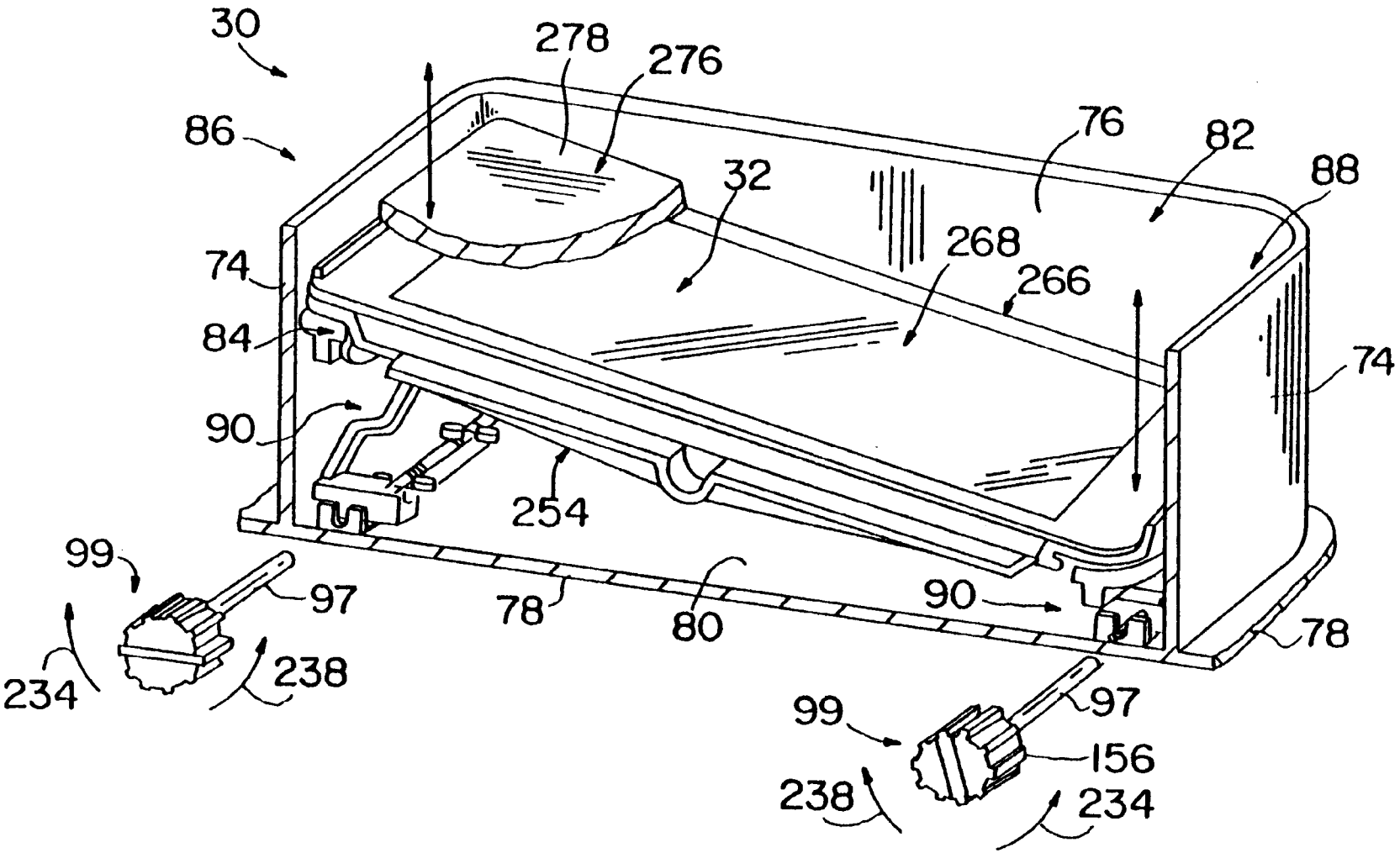
FIG. 2 is a perspective view of the patient-support apparatus of FIG. 1, with portions broken away, showing inner walls of a platform tub defining an interior region and a patient-support assembly including a deck assembly and a pair of elevation mechanisms supporting the deck assembly in the interior region.

Platform tub 30 includes outer end walls 70 and outer side walls 72 as shown in FIG. 1. Platform tub 30 also includes inner end walls 74 and inner side walls 76 as shown in FIG. 2. Outer end walls 70, outer side walls 72, inner end walls 74, and inner side walls 76 all extend upwardly from a bottom panel 78 of platform tub 30. Bottom panel 78 includes an upwardly-facing platform surface 80. Inner end walls 74 and inner side walls 76 cooperate to define an interior region or mattress well 82 above platform surface 80. Patient-support assembly 32 is received in interior region 82 and is coupled to bottom panel 78 of platform tub 30 as shown in FIG. 2.

Figure 3:
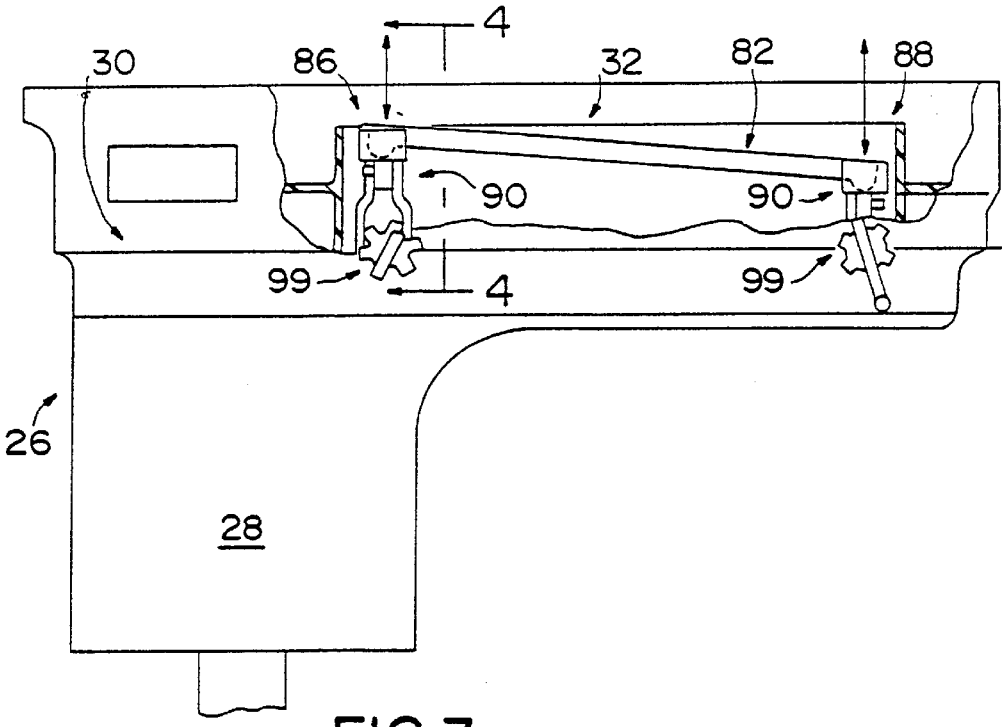
FIG. 3 is a side elevation view of the patient-support apparatus of FIG. 1, with portions broken away, showing one end of the deck assembly elevated above the other end of the deck assembly.

Patient-support assembly 32 includes a deck assembly 84 having a first end 86 and a second end 88 longitudinally spaced apart from first end 86. Patient-support assembly 32 also includes a pair of elevation mechanisms 90, each of which are independently operable to raise and lower the respective overlying first and second ends 86, 88 of deck assembly 84. Elevation mechanisms 90 allow deck assembly 84 to be tilted in a first direction to a Trendelenburg position and in a second direction to a reverse Trendelenburg position. In addition, elevation mechanisms 90 are operable to place deck assembly 84 in an infinite number of positions between the Trendelenburg and reverse Trendelenburg positions. One possible position of deck assembly 84 is shown in FIG. 3.

Each elevation mechanism 90 includes a linkage 96 and a driver 95 that is operable to move linkage 96 to, thereby, raise and lower the respective overlying first and second ends 86, 88 of deck assembly 84. It will be appreciated that various mechanical and electromechanical actuators and drivers may be used to move linkage 96 without exceeding the scope of the invention as presently perceived. It is well known in the hospital patient-support art that electric drive motors with various types of transmission elements including lead screw drives and various types of mechanical linkages may be used to cause relative movement of portions of hospital stretchers, beds, chairs, and the like. As a result, the term "driver" in the specification and in the claims is intended to cover all types of mechanical, electromechanical, hydraulic, and pneumatic mechanisms, including manual cranking mechanisms of all types and including combinations of the above elements for actuating linkages 96 to raise and lower ends 86, 88 of deck assembly 84, unless a particular driver embodiment is referred to specifically.

Figure 4:
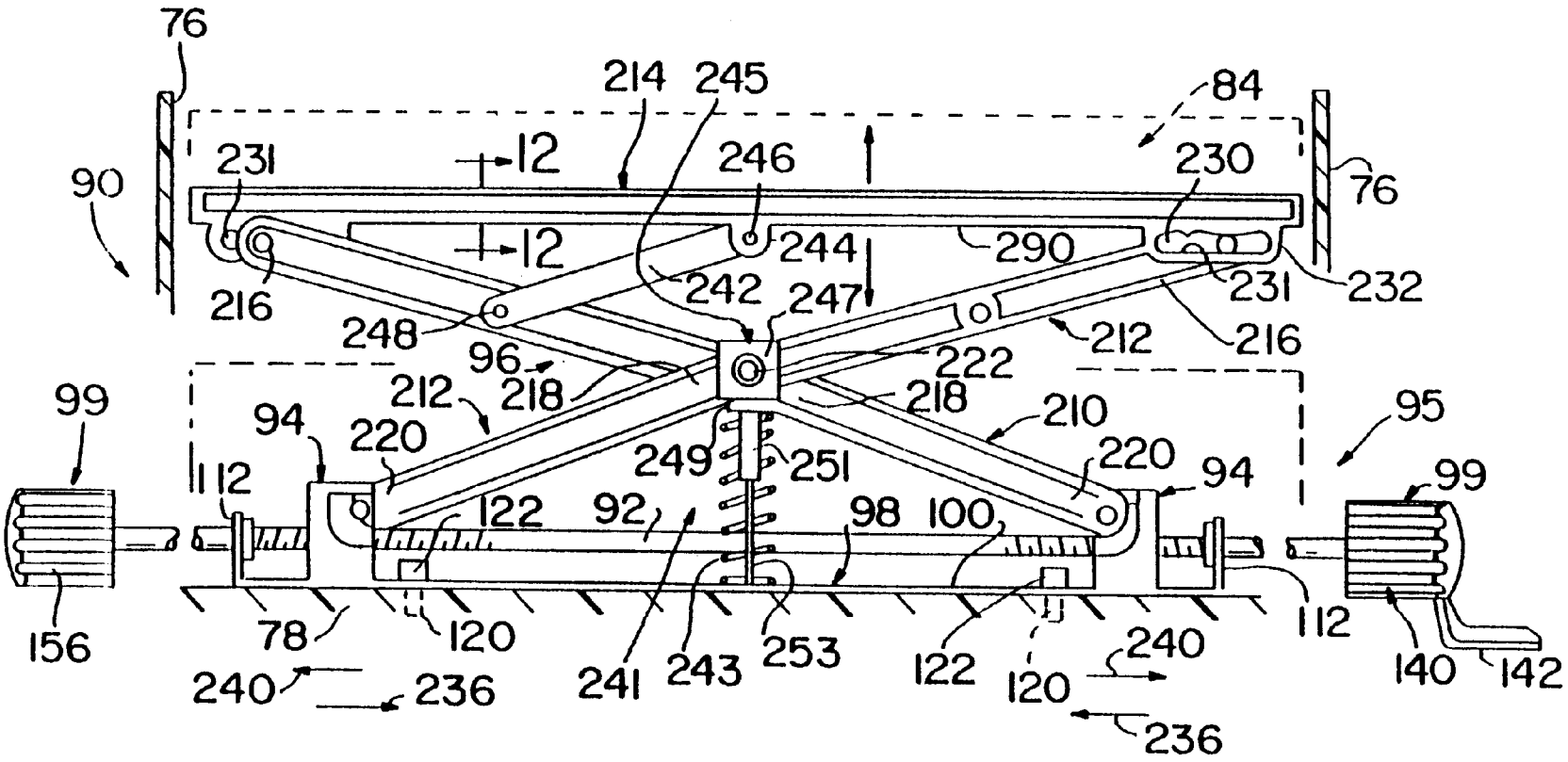
FIG. 4 is a sectional view, taken along line 4—4 of FIG. 3, showing the elevation mechanism including a linkage having first and second links coupled together in a "scissors" arrangement, lower ends of the first and second links coupled to respective blocks that move transversely in response to rotation of a threaded shaft to which the blocks are coupled, upper ends of the first and second links coupled to a deck-engaging link of the linkage at slots formed therein, and a control link of the linkage coupling the first link to a central portion of the deck-engaging link.
Figure 5:
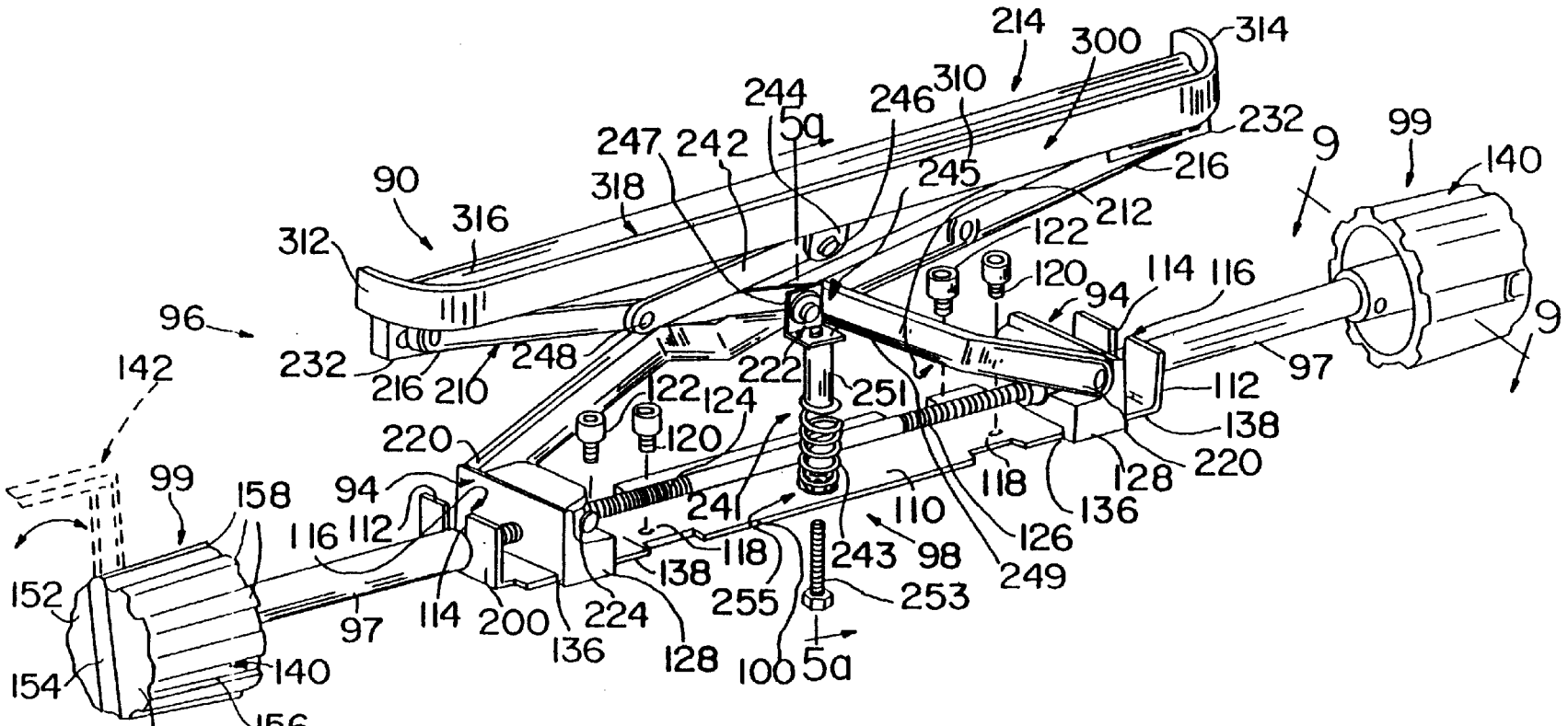
FIG. 5 is a perspective view of one of the elevation mechanisms of FIG. 2 showing a pair of knobs for rotating the threaded shaft, a shaft extender coupling each knob to the threaded shaft, a base plate on which the blocks slide when the knobs are used to rotate the threaded shaft, and a spring lift assembly having a spring extending upwardly from the base plate and a spring bracket that engages and compresses the spring as the deck-engaging link is lowered by the first and second links.

For example, a preferred driver 95 includes a transversely-extending threaded shaft 92, a pair of blocks 94 threadedly coupled to shaft 92, a pair of knobs 99 for rotating threaded shaft 92, and a shaft extender 97 coupling each knob to an end of threaded shaft 92 as shown in FIGS. 4 and 5. In such an embodiment of driver 95, linkage 96 is coupled to blocks 94 and extends upwardly therefrom to support the end 86, 88 of deck assembly 84 to be moved by the respective elevation mechanism 90. Driver 95 of elevation mechanism 90 includes a base plate 98 having a transversely-extending central portion 100 with an upwardly-facing surface 110.

Base plate 98 includes a pair of upwardly-extending stop flanges 112 at the ends of central portion 100. Each stop flange 112 includes a U-shaped edge 114 defining a slot 116 having an open upper end and a curved lower end as shown best in FIG. 2. Portions of threaded shaft 92 are received in slots 116 and threaded shaft 92 is supported for rotation relative to base plate 98. Base plate 98 is made from stainless steel, although other materials also would suffice.

Blocks 94 slide transversely on upwardly-facing surface 110 when threaded shaft 92 rotates. Stop flanges 112 limit the transverse movement of blocks 94 away from one another. Central portion 100 of base plate 98 is formed to include a plurality of apertures 118 and a cap screw 120 extends through each aperture 118 into threaded engagement with bottom panel 78 of platform tub 30 as shown in FIG. 4. Threaded engagement of cap screws 120 with bottom panel 78 couples elevation mechanisms 90 to platform tub 30. In addition, each cap screw 120 includes a stop portion 122 above the central portion 100 of base plate 98. Stop portions 122 of cap screws 120 limit the transverse movement of blocks 94 toward one another. In a preferred embodiment, stop flanges 112 and stop portions 122 of cap screws 120 are arranged so that each block 94 can move about one inch (2.54 cm) on base plate 98 as threaded shaft 92 rotates.

Figure 6:
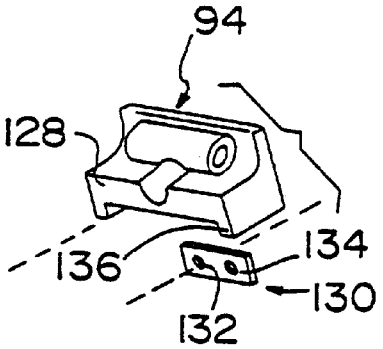
FIG. 6 is an exploded view of one of the blocks of FIG. 5 showing a drive block portion and a nut plate beneath the drive block portion.

One portion of threaded shaft 92 is formed with a right-handed thread 124 and another portion of threaded shaft 92 is formed with a left-handed thread 126. In addition, each block 94 includes a drive block portion 128 and a nut plate 130 as shown in FIG. 6. Each nut plate 130 is formed to include a first aperture 132 having a right-handed thread and a second aperture 134 having a left-handed thread. During assembly of each elevation mechanism 80, nut plates 130 are coupled to the respective drive block portions 128 so that first aperture 132 mates with the portion of threaded shaft 92 having right-handed thread 124 and so that second aperture 134 mates with the portion of threaded shaft 92 having left-handed thread 126. Thus, each nut plate 130 is "reversible" which allows drive block portions 128 and nut plates 130 to be identically constructed and then assembled together in the appropriate manner to properly mate with threaded shaft 92.

In preferred embodiments, each of threads 124, 126 and the threads formed in apertures 132, 134 are 5/16 threads. In addition, threaded shaft 92 is made from stainless steel and has a 5/16 inch (0.794 cm) diameter. Nut plate is made from brass and is stamped to indicate the direction of the threads formed in apertures 132, 134. Each drive block portion 128 is injection molded from an acetal plastics material, such as Celcon™ M90, to provide low friction bearing surfaces between drive block portions 128 and linkage 96 and between drive block portions 128 and base plate 98 on which drive block portions 128 slide as previously described.

Each drive block portion 128 is formed to include a pair of longitudinally spaced-apart, transversely-extending guide lugs 136 as shown in FIGS. 5 and 6. Central portion 100 of base plate 98 includes side edges 138 that extend downwardly from upwardly-facing surface 110 toward bottom panel 78 of platform tub 30. Central portion 100 of base plate 98 is positioned to lie between guide lugs 136. Guide lugs 136 are positioned to lie adjacent to side edges 138 to guide the transverse movement of blocks 94. Thus, when threaded shaft 92 rotates, guide lugs 136 ensure that blocks 94 slide transversely on base plate 98.

Knobs 99 are coupled to threaded shaft 92 by shaft extenders 97 and are used to rotate threaded shaft 92 as previously described. Each knob 99 includes a knob body 140 and a fold-out crank handle 142 as shown, for example, in FIGS. 4, 5, and 8–10. The description below of one of knobs 99 and the operation thereof applies to all of knobs 99 unless specifically noted otherwise.

Figure 8:
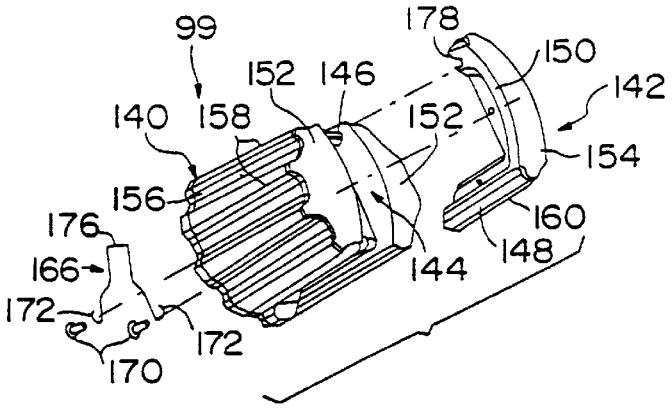
FIG. 8 is an exploded view of one of the knobs of FIG. 5 showing a knob body, a crank handle in front of the knob body, and a wire spring behind the knob body.
Figure 9:
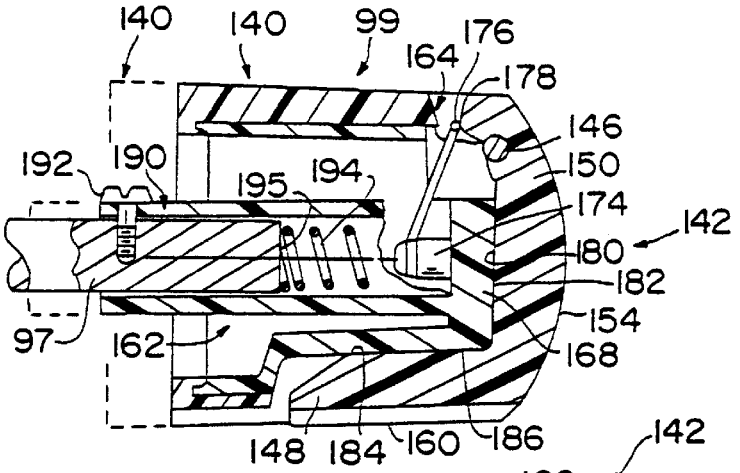
FIG. 9 is a sectional view, taken along line 9—9 of FIG. 5, showing the crank handle in a stored position embedded within a recess of the knob body.
Figure 10:
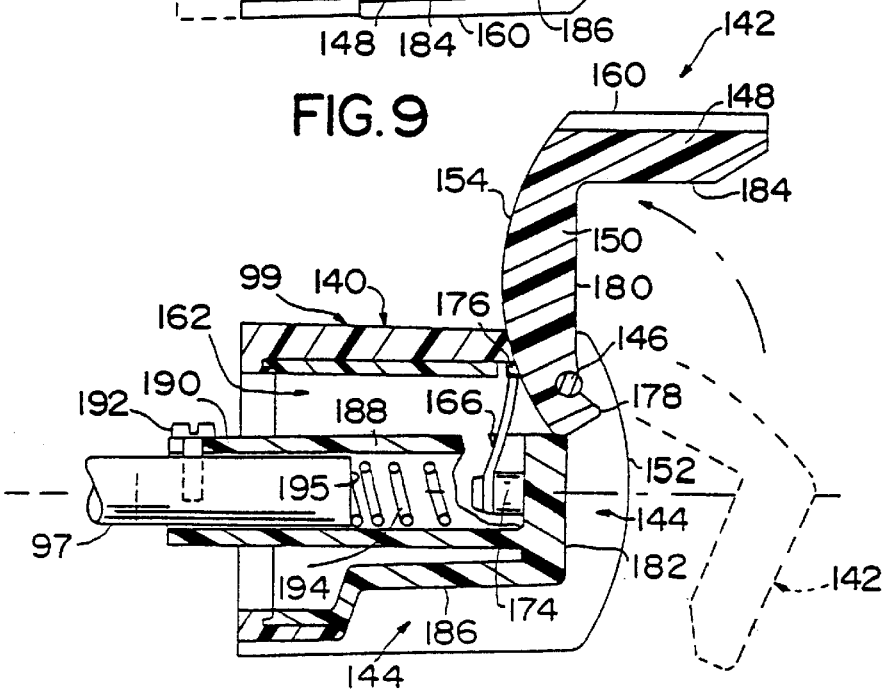
FIG. 10 is a view similar to FIG. 9 showing the crank handle folded out of the recess to a use position in which the crank handle is used to quickly rotate the knob body, the shaft extender, and the threaded shaft.

Knob body 140 is formed to include an L-shaped recess 144 as shown best in FIG. 8. A pivot pin 146 couples crank handle 142 to knob body 140 as shown in FIGS. 9 and 10. Crank handle 142 can pivot on pivot pin 146 between a stored position in which crank handle 142 is positioned to lie within recess 144 of knob body 140, as shown in FIG. 9, and a use position in which crank handle 142 is substantially outside recess 144, as shown in FIG. 10. Crank handle 142 can be used to rotate threaded shaft 92 when in the use position. In preferred embodiments, crank handle 142 and knob body 140 both are made of a glass-filled nylon core that is overmolded with a Santoprene™ elastomer.

Crank handle 142 is substantially L-shaped and includes a handle portion 148 and a throw arm portion 150. Knob body 140 includes a curved end surface 152 that is interrupted by recess 144 and throw arm portion 150 includes a curved surface 154 that matches the contour of curved end surface 152. When crank handle 142 is in the stored position, curved surface 154 cooperates with curved end surface 152 to provide knob 99 with a substantially uninterrupted end surface 152, 154 as shown in FIG. 5. Knob body 140 also includes a ribbed gripping surface 156 having a plurality of ribs 158 that are spaced circumferentially about the perimeter of knob body 140. Recess 144 interrupts ribbed gripping surface 156 at a position where one of ribs 158 would be located if knob body 140 were formed without recess 144. Handle portion 148 of crank handle 142 is formed to include a rib 160. When crank handle 142 is in the stored position, rib 160 is located at a position that is consistent with the circumferential spacing of ribs 158 of knob body 140. Thus, crank handle 142 is "embedded" in knob body 140 when in the stored position and conforms to the overall shape of knob body 140.

When crank handle 142 is in the stored position, rotation of the associated knob 99 results in minor adjustments being made to the position of blocks 94 along threaded shaft 92, thereby resulting in minor adjustments being made to the vertical position of the respective end 86, 88 of deck assembly 84. When crank handle 142 is in the use position, handle portion 148 can be grasped loosely and "cranked" to rotate the associated knob body 140, shaft extender 97, and threaded shaft 92 quickly. The cranking motion of handle portion 148 results in major adjustments being made to the position of blocks 94 along threaded shaft 92, thereby resulting in major adjustments being made to the vertical position of the respective end 86, 88 of deck assembly 84. Thus, when crank handle 142 is in the use position, the rotational speed with which a caregiver can rotate threaded shaft 92 is increased so that more radical adjustments to the position of deck assembly 84 can be made in a shorter period of time.

Knob body 140 is formed to include both an interior region 162 and a spring-receiving passage 164 as shown in FIG. 9. A wire spring 166 is coupled to a front wall 168 of knob body 140 by a pair of screws 170 that clamp looped free ends 172 of wire spring 166 against screw bosses 174 that are appended to front wall 168 in interior region 162. Wire spring 166 includes an end portion 176 positioned to lie in spring-receiving passage 174. Throw arm portion 150 of crank handle 142 includes a tip 178 that is engaged by end portion 176 of wire spring 166 when crank handle 142 is in the stored position. Engagement between end portion 176 and tip 178 biases crank handle 142 into the stored position. When crank handle 142 is in the stored position, a flat surface 180 of throw arm portion 150 is spring-biased against a flat surface 182 of front wall 168 and a flat surface 184 of handle portion 148 is spring-biased against a flat surface 186 of knob body 140 as shown in FIG. 9.

Figure 7:
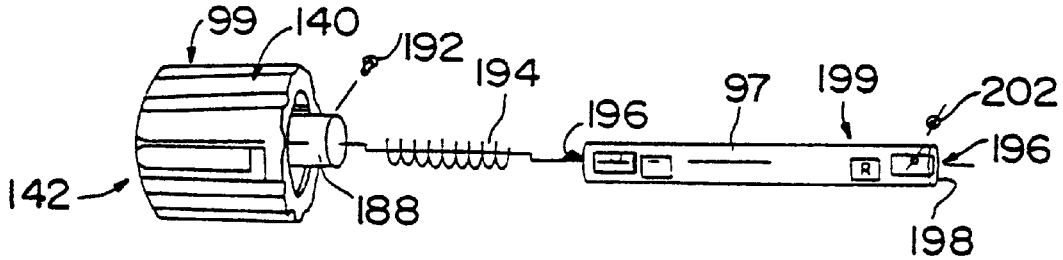
FIG. 7 is an exploded view of a portion of the elevation assembly of FIG. 5 showing a spring interposed between the knob and the shaft extender.

Knob 99 includes a cylindrical hub 188 appended to front wall 168 of knob body 140 and extending axially therefrom as shown in FIGS. 9 and 10. A slot 190 is formed at a distal end of cylindrical hub 188. A pin 192 extends through slot 190 and attaches to an end of shaft extender 97 as shown in FIGS. 7, 9, and 10. Receipt of pin 192 in slot 190 of cylindrical hub 198 provides for the transmission of torque between knob 99 and shaft extender 97. A coil spring 194 is compressed between an end surface 195 of shaft extender 97 and front wall 168 of knob body 140 so that knob 99 is normally biased into an axially outward position. Thus, spring 194 and shaft extender 97 are interposed between knob 99 and threaded shaft 92.

Slot 190 extends axially along cylindrical hub 188 so that knob 99 is permitted to move axially inwardly relative to shaft extender 97 as shown in FIG. 9 (in phantom). For example, if knob 99 is inadvertently bumped, slot 190 allows knob 99 to move axially inwardly to further compress spring 194. After knob 99 is bumped, spring 194 acts to return knob 99 back to its axially outward position. Thus, spring 194 provides axial shock absorption between knob 99 and the rest of patient-support apparatus 20.

In a preferred embodiment, each shaft extender 97 is a symmetrical screw machined part made from stainless steel. A shaft-receiving bore 196 is formed at each end of shaft extender 97 as shown in FIG. 7. One of shaft-receiving bores 196 is formed with a right-handed thread and the other of shaft-receiving bores is formed with a left-handed thread. Indicia 199 is provided at each end of shaft extenders 97 to indicate the direction of the threads formed in each shaft-receiving bore 196. The threads of shaft-receiving bores 196 are 5/16 threads and outer ends of threaded shaft 92 are threadedly received in respective shaft-receiving bores 196. A radially-extending set screw 202 is threaded through each shaft extender 97 into engagement with threaded shaft 92 to secure threaded shaft 92 and shaft extenders 97 together.

Shaft extenders 97 have a larger diameter than threaded shaft 92 as shown in FIGS. 4 and 5. Each shaft extender 97 includes an inner end surface 198, shown in FIG. 7, and shaft extenders 97 are mounted on the ends of threaded shaft 92 so that inner end surfaces 198 abut an outer surface 200 of respective stop flanges 112. Abutment of inner end surfaces 198 with outer surfaces 200 of respective stop flanges 112 prevents threaded shaft 92 from shifting transversely relative to base plate 98.

Outer and inner side walls 72, 76 of platform tub 30 are formed to include apertures (not shown) that are aligned to receive respective shaft extenders 97 therethrough. Knobs 99 are mounted to shaft extenders 97 beyond outer side walls 72 of platform tub 30. A set of 45 durometer Santoprene™ bushings with off-the-shelf bearing sleeves (not shown) provide rotative bearing support between shaft extenders 97 and platform tub 30. Providing bearing support between shaft extenders 97 and platform tub 30 maintains threaded shaft 92 in spaced-apart relation with edge 114 of base plate 98, thereby preventing damage to threads 124, 126 of threaded shaft 92.

Transverse movement of blocks 94, in response to rotation of knobs 99, shaft extenders 97, and threaded shaft 92, actuates linkage 96 to raise and lower the respective overlying first and -second ends 86, 88 of deck assembly 84 as previously described. The description below of one of linkages 96 and the operation thereof applies to both of linkages 96 unless specifically noted otherwise.

Figure 5A:
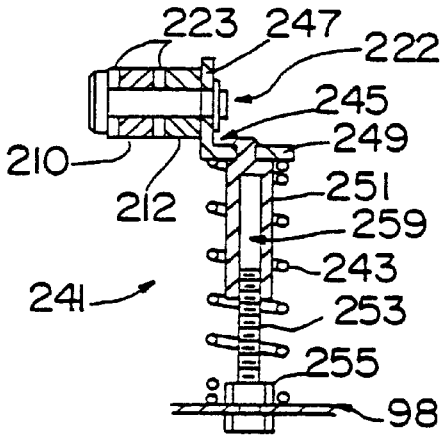
FIG. 5*a* is a sectional view taken along line 5*a*—5*a* of FIG. 5 showing a spring guide of the spring lift assembly extending downwardly from the spring bracket through the spring and a stud of the spring lift assembly extending upwardly from the base plate through the spring to be received in a stud-receiving bore formed in the spring guide.

Linkage 96 of elevation mechanism 90 includes a first link 210, a second link 212, and a deck-engaging link or end support 214 as shown in FIGS. 4 and 5. First and second links 210, 212 each include an upper end 216, a middle portion 218, and a lower end 220. Middle portion 218 of first link 210 is pivotably coupled to middle portion 218 of second link 212 by a pivot pin 222 and a set of nylon washers 223 as shown in FIG. 5*a*. Thus, first and second links 210, 212 are configured in a crossing or "scissors" arrangement.

A lower pin (not shown) fixed to lower end 220 of each link 210, 212 extends transversely therefrom into pin-receiving apertures formed in the respective drive block portion 128 and a screw and steel washer assembly 224 secures each lower pin to the respective drive block portion 128. Receipt of the lower pin in the respective drive block portion 128 pivotably couples first and second links 210, 212 to respective blocks 94. Deck-engaging link 214 includes a pair of transversely spaced-apart slot blocks 226 that are appended to a bottom surface 290 thereof as shown in FIGS. 4 and 5. Each slot block 226 is formed to include an edge 231 defining a slot 230. An upper pin (not shown) fixed to upper end 216 of each link 210, 212 extends transversely therefrom into the respective slot 230 of slot block 226 and an O-ring (not shown) is rolled into place on each upper pin to secure upper ends 216 of links 210, 212 to respective slot blocks 226. Receipt of the upper pins in slots 230 of respective slot blocks 226 slidably and pivotably couples first and second links 210, 212 to slot blocks 226. Thus, lower ends 220 of first and second links 210, 212 are pivotably coupled to respective blocks 94 and upper ends 216 of first and second links 210, 212 are pivotably and slidably coupled to deck-engaging link 214.

When threaded shaft 92 is rotated in a first direction 234, shown in FIG. 2, blocks 94 move toward one another in directions 236, shown in FIG. 4, so that lower ends 220 of first and second links 210, 212 are simultaneously moved in directions 236 toward one another. As lower ends 220 of first and second links 210, 212 move in directions 236, first and second links 210, 212 pivot upwardly about pivot pin 222 relative to one another, thereby raising the respective upper ends 216 of links 210, 212 and causing upper ends 216 to simultaneously move toward one another. As upper ends 216 of links 210, 212 move toward one another, the upper pins appended to links 210, 212 slide in respective slots 230 toward one another and lift deck-engaging link 214 away from platform tub 30. Thus, rotation of threaded shaft 92 in first direction 234 causes deck-engaging link 214 to be lifted upwardly.

When threaded shaft 92 is rotated in a second direction 238, shown in FIG. 2, blocks 94 move away from one another in directions 240, shown in FIG. 4, so that lower ends 220 of first and second links 210, 212 are simultaneously moved in directions 240 away from one another. As lower ends 220 of first and second links 210, 212 move in directions 240, first and second links 210, 212 pivot downwardly about pivot pin 222 relative to one another, thereby lowering the respective upper ends 216 of links 210, 212 and causing upper ends 216 to simultaneously move away from one another. As upper ends 216 of links 210, 212 move away from one another, the upper pins appended to links 210, 212 slide in respective slots 230 away from one another and lower deck-engaging link 214 toward platform tub 30. Thus, rotation of threaded shaft 92 in second direction 238 causes deck-engaging link 214 to be dropped downwardly.

When linkage 96 supports deck-engaging link 214 in a raised position, links 210, 212 are oriented more vertically than horizontally and a force caused by the weight of deck assembly 84 and linkage 96 is transmitted through blocks 94 mostly to upper surface 110 of base plate 98. As deck-engaging link 214 is lowered toward base plate 98, first and second links 210, 212 pivot about pivot pin 22 and become increasingly more horizontal. As links 210, 212 become increasingly more horizontal, the force acting on blocks 94 through links 210, 212 becomes increasingly more horizontal. Thus, as links 210, 212 pivot to lower deck-engaging link 214, the direction of the force acting on blocks 94 changes such that nut plates 130 are pressed against respective threads 124, 126 of threaded shaft 92 with an increasing amount of thrust force. As the thrust force of nut plates 130 against threads 124, 126 increases, due to the lowering of deck-engaging link 214, the amount of torque that a caregiver must apply to knobs 99 to actuate linkage 96 increases.

Elevation mechanism 90 includes a spring lift assembly 241 that acts between base plate 98 and linkage 96 to reduce the amount of thrust force acting between nut plates 130 and threaded shaft 92 as links 210, 212 become increasingly more horizontal during the lowering of deck-engaging link 214. Spring lift assembly 241 includes a spring 243 extending upwardly from base plate 98 and a spring bracket 245 coupled to pivot pin 222 as shown in FIGS. 4, 5, and 5*a*. Spring bracket 245 includes a substantially vertical plate 247 that couples to pivot pin 222 and a substantially horizontal plate 249 that extends away from vertical plate 247 and over spring 243.

When linkage 96 supports deck-engaging link 214 in a fully-raised position, horizontal plate 249 is spaced apart from the top end of spring 243. In a preferred embodiment, horizontal plate 249 is spaced apart from the top end of spring 243 by one inch (2.54 cm) when deck-engaging link 214 is in the fully-raised position.

As elevation mechanism 90 is actuated to lower deck-engaging link 214 from the fully-raised position toward base plate 98, horizontal plate 249 moves toward the top end of spring 243. Further actuation of elevation mechanism 90 to lower deck-engaging link 214, causes horizontal plate 249 of spring bracket 245 to engage and compress spring 243. When compressed, spring 243 acts between base plate 98 and horizontal plate 249 to bias pivot pin 222, and hence, links 210, 212, upwardly. Thus, when linkage 96 is lowered to the extent that horizontal plate 249 compresses spring 243, spring 243 provides a biasing force that opposes the force created by the weight of deck assembly 84 and linkage 96 to thereby, reduce the thrust force created between nut plates 130 and threads 124, 126 of threaded shaft 92.

Spring lift assembly 241 further includes a spring guide 251 coupled to, and extending downwardly from, horizontal plate 249 of spring bracket 245 and a stud bolt 253 coupled to, and extending upwardly from, base plate 98 as shown in FIGS. 4, 5, and 5*a*. Stud bolt 253 is threadedly coupled to a nut 255 that is situated atop base plate 98 to secure stud bolt 253 to base plate 98 as shown best in FIG. 5*a*. Spring 243 is a coiled compression spring having an interior region. Portions of stud bolt 253 and spring guide 251 are received in the interior region of spring 243. In a preferred embodiment, when linkage 96 supports deck-engaging link 214 in the fully-raised position, approximately ½ inch (cm) of spring guide 251 is received in the interior region of spring 243. Spring guide 251 is formed to include a stud-receiving bore 259 as shown in FIG. 5*a*. As elevation mechanism 90 is actuated to lower deck-engaging link 214, spring guide 251 moves downwardly so that stud bolt 253 is received in spring-receiving bore 259 of spring guide 251. Spring guide 251 cooperates with stud bolt 253 to maintain vertical alignment between spring 243 and horizontal plate 249 and to prevent spring 243 from buckling.

Linkage 96 includes an idler arm or control link 242 coupled to a center flange 244 of deck-engaging link 214 by a pivot pin 246 and coupled to first link 210 by a pivot pin 248 as shown in FIGS. 4 and 5. Control link 242 prevents deck-engaging link 214 from shifting transversely relative to first and second links 210, 212 when first and second links 210, 212 are stationary. Pivot pin 246 is vertically aligned with pivot pin 222 and the distance between pivot pin 246 and pivot pin 248 is substantially equal to the distance between pivot pin 248 and pivot pin 222. This arrangement of control link 242 and pivot pins 222, 246, 248 keeps deck-engaging link centered relative to first and second links 210, 212 and constrains deck-engaging link 214 from moving transversely during vertical movement of deck-engaging link 214.

In preferred embodiments, control link 242 and pivot pins 222, 246, 248 are made out of stainless steel and pivot pins 222, 246, 248 are each held in place by conventional E-clips. In addition, deck-engaging link 214 is made of ¼ inch Noryl™ injection molded structural foam for light weight structural integrity and dimensional repeatability. In preferred embodiments, first and second links 210, 212 are die cast from a zinc aluminum alloy so that links 210, 212 have high strength characteristics while maintaining dimensional integrity and repeatability. First and second links 210, 212 each have a powder coat finish for protection and enhanced cleanability. The upper and lower pins of links 210, 212 are integrally cast with the rest of respective first and second links 210, 212. In addition, first and second links 210, 212 are cast to be essentially identical in shape but are arranged to face in opposite directions during assembly. Thus, the upper pins of first and second links 210, 212 extend away from respective first and second links 210, 212 in opposite directions and the lower pins of first and second links 210, 212 extends away from respective first and second links 210, 212 in opposite directions.

One of nylon washers 223 is sandwiched between middle portions 218 of first and second links 210, 212 as shown in FIG. 5. First and second links 210, 212 are bent so that lower ends 220 of each link 210, 212 are offset from the respective middle portions 218 by a sufficient amount to accommodate the width of blocks 94. In addition, first and second links 210, 212 are bent so that upper ends 216 of each link are offset from the respective middle portions 218 by a sufficient amount to accommodate the width of slot blocks 226. Because of the manner in which first and second links 210, 212 are bent, and because first and second links 210, 212 are arranged to face in opposite directions during assembly, lower ends 220 of first and second links 210, 212 are coupled to respective blocks 94 on opposite sides of an imaginary transversely extending vertical reference plane 250, shown in FIG. 3, passing through threaded shaft 92 and slot blocks 226. In addition, upper ends 216 of first and second links 210, 212 are coupled to respective slot blocks 226 on opposite sides of vertical reference plane 250.

Edge 231 of each slot block 226 is formed to include a set of notches 252 and the upper pins appended to upper ends 216 of links 210, 212 are received in notches 252 when links 210, 212 reach a predetermined position. Receipt of the upper pins of links 210, 212 in notches 252 provides "feedback resistance" to elevation mechanisms 90 so that a caregiver using knobs 99 to adjust the elevation and inclination of deck assembly 84 can feel the receipt of the upper pins in notches 252. Based on the feedback resistance provided to knobs 99 associated with elevation mechanisms 90 at both ends 86, 88 of deck assembly 84, the caregiver can determine when deck assembly 84 reaches a horizontal or level position.

Deck-engaging links 214 support respective ends 86, 88 of deck assembly 84 as previously described. Deck assembly 84 includes a patient-support deck 254, shown in FIG. 11, that rests upon deck-engaging links 214. Patient-support deck 254 includes elevated end portions 256, a lowered central portion 258 between end portions 256, and a tray-guiding wall 260 coupling each end portion 256 to central portion 258. Deck assembly 84 also includes an x-ray tray 262 and an x-ray grid template 263 carried by x-ray tray 262. X-ray tray is slidably supported by central portion 258 of patient-support deck 254.

Figure 11:
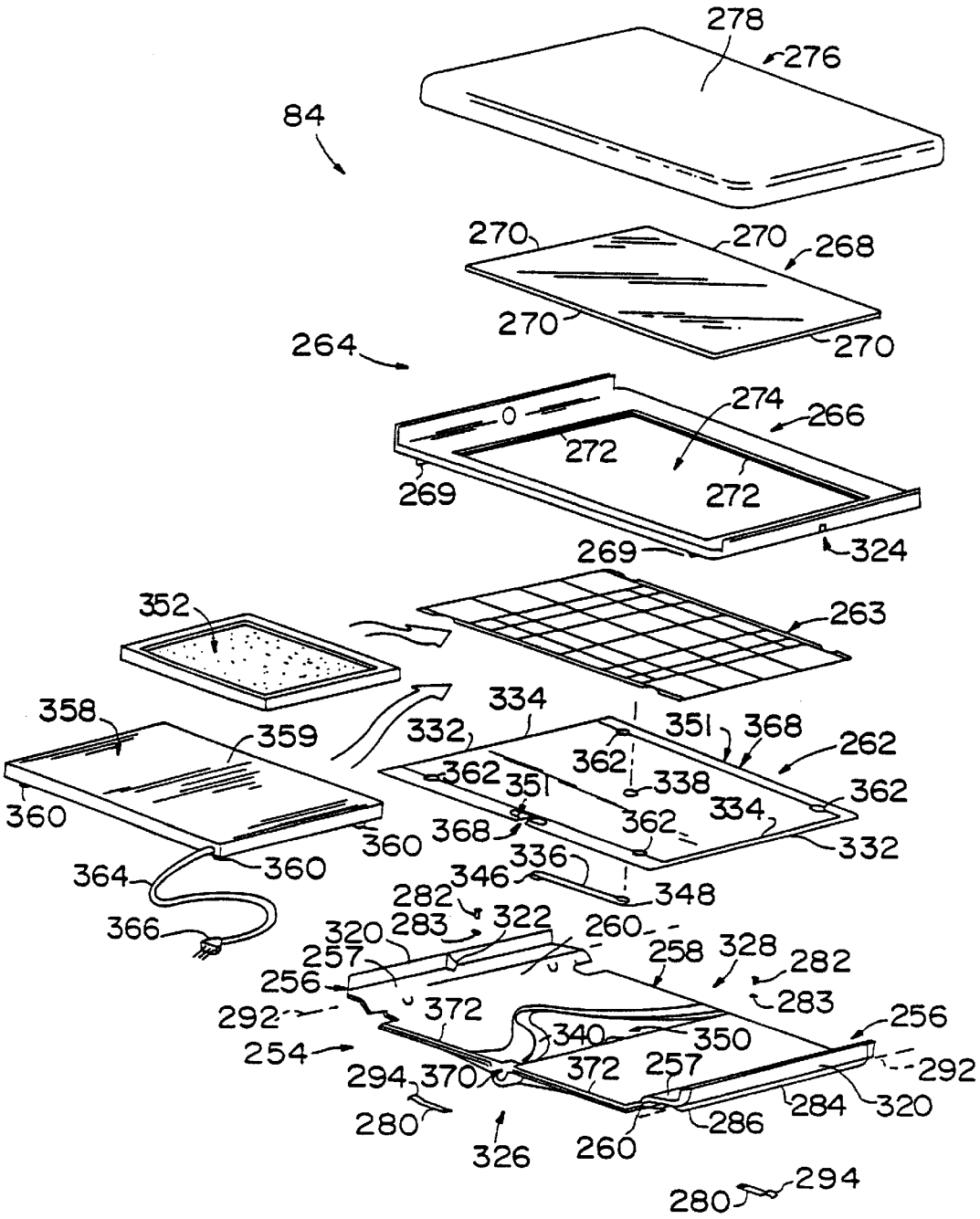
FIG. 11 is an exploded view of the deck assembly of FIG. 2 showing, from the top of the page to the bottom of the page, a mattress, a mattress support including an x-ray window pane and an x-ray window frame, an x-ray grid template, an x-ray tray, a link pivotably coupled to the x-ray tray, and a patient-support deck including a slot in which a portion of the link is received for sliding and pivoting movement and showing a cassette of x-ray film and a weigh scale that can be carried alternatively by the x-ray tray.

Deck assembly 84 includes a mattress support 264 that is supported by end portions 256 of patient-support deck 254. Mattress support 264 includes an x-ray window frame 266 and an x-ray window pane 268. X-ray window pane 268 includes a perimetral portion 270 received in a groove 272 that borders a large pane-receiving aperture 274 formed in window frame 266 as shown in FIG. 11. Deck assembly 84 further includes a mattress 276 supported by mattress support 264. Mattress 276 has an upwardly-facing patient-support surface 278 on which a patient, such as an infant, can rest while being supported by patient-support apparatus 20.

Figure 12:
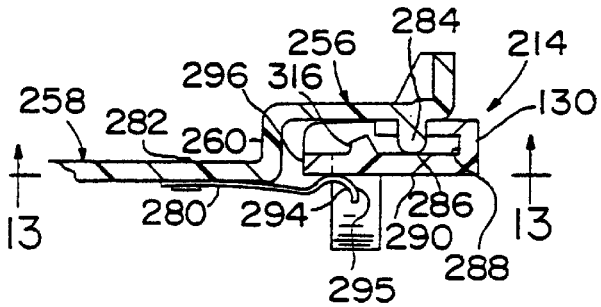
FIG. 12 is a sectional view, taken along line 12—12 of FIG. 4, showing a downwardly-facing surface of a rib formed in the patient-support deck of the deck assembly engaging an upwardly-facing surface of the deck-engaging link and a retainer coupled to the patient-support deck engaging a bottom surface of the deck-engaging link.

Patient-support deck 254 includes a transverse rib 284 appended to each end portion 256 and extending downwardly therefrom. Rib 284 is formed to include a downwardly-facing surface 286. Deck-engaging link 214 includes an upwardly-facing surface 288 and a bottom surface 290 as shown in FIG. 12. Downwardly-facing surface 286 of rib 284 engages upwardly-facing surface 288 of deck-engaging link 214 to provide pivoting and sliding bearing engagement between patient-support deck 254 and deck-engaging link 214, thereby allowing patient-support deck 254 to pivot and slide relative to deck-engaging link 214 as elevation mechanisms 90 raise and lower ends 86, 88 of deck assembly 84. Downwardly-facing surface 286 of each rib 284 is convex to provide a respective transverse axis 292, shown in FIG. 11, that patient-support deck 254 pivots about during raising and lowering of respective elevation mechanisms 90.

Deck-engaging link 214 is formed to include a rim 300 extending upwardly from surface 288 as shown in FIG. 5. Rim 300 includes an outer transverse rim portion 310 and curved first and second end rim portions 312, 314 that are integrally appended to outer transverse rim portion 310. In addition, deck-engaging link 214 is formed to include a transverse lip 316 extending upwardly from surface 288. Transverse lip 316 is longitudinally spaced apart from outer transverse rim portion 310 and interconnects curved end rim portions 312, 314 to provide deck-engaging link 214 with a rib-receiving space 318 as shown in FIG. 5.

Rib 284 is received in rib-receiving space 318 and is surrounded by rim 300 and transverse lip 316. Outer transverse rim portion 310 of rim 300 cooperates with transverse lip 316 to limit the amount by which rib 284 can slide longitudinally on deck-engaging link 214, thereby limiting the amount that patient-support deck 254 can move longitudinally relative to elevation mechanisms 90. In addition, first end rim portion 312 cooperates with second end rim portion 314 to limit the amount by which rib 284 can slide transversely on deck-engaging link 214, thereby limiting the amount that patient-support deck 254 can move transversely relative to elevation mechanisms 90.

Figure 13:
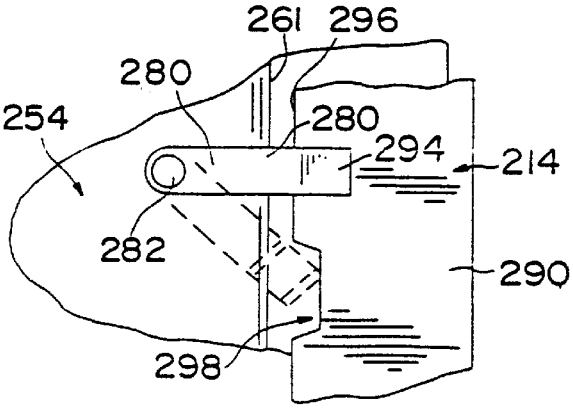
FIG. 13 is a bottom plan view of the patient-support deck and deck-engaging link, taken along line 13—13 of FIG. 11, showing the deck-engaging link having a notch and the retainer pivoted relative to the patient-support deck into alignment with the notch (in phantom)

Deck assembly 84 includes a pair of retainers 280 positioned to lie beneath patient-support deck 254 and coupled thereto by respective pivot pins 282 and washers 283 as shown in FIGS. 11–13. Each retainer 280 includes a curved portion 294 having an upwardly-facing convex surface 295 as shown best in FIG. 12. Each retainer 280 is pivotable between a retaining position, shown in FIG. 12, in which curved portion 294 engages bottom surface 290 of the respective deck-engaging link 214 to prevent separation of deck assembly 84 away from the respective elevation mechanism 90, and a releasing position, shown in FIG. 13 (in phantom), in which curved portion 294 is spaced apart from bottom surface 290 of the respective deck-engaging link 214 to allow separation of deck assembly 84 away from the respective elevation mechanism 90.

When retainers 280 are in the retaining positions, upwardly-facing convex surfaces 295 of curved portions 294 engage bottom surfaces 290 of deck-engaging links 214 so that, as ends 86, 88 of deck assembly 84 are raised and lowered by elevation mechanisms 90, curved portions 294 of retainers 280 pivot and slide relative to respective bottom surfaces 290 of deck-engaging links 214. When retainers 280 are in the releasing positions, the curved portions 294 contact an outside surface 261 of respective tray-guiding walls 260 as shown in FIG. 13 (in phantom). Each deck-engaging link 214 includes a transverse edge 296 extending between upwardly-facing surface 288 and bottom surface 290 as shown in FIG. 12. Each edge 296 is formed to include a notch 298 as shown in FIG. 13. When retainers 280 are in the releasing positions, curved portions 294 are aligned with respective notches 298 so that, as deck assembly 84 is separated away from elevation mechanisms 90, curved portions 294 move through notches 298 without interference from deck-engaging link 214.

Each end portion 256 of patient-support deck includes an upwardly-facing support surface 257 and x-ray window frame 266 is formed to include a pair of longitudinally spaced-apart, downwardly-extending ribs 269 that engage respective support surfaces 257. Patient-support deck 254 includes a pair of end rims 320, each of which extend upwardly from respective end portions 256 as shown in FIGS. 11 and 12. End rims 320 are positioned to lie just beyond the longitudinal ends of mattress support 264 to prevent longitudinal movement of mattress support 264 relative to patient-support deck 254. Patient-support deck 254 is formed to include a pair of tabs 322, each of which interconnect respective end rims 320 and support surfaces 257. A notch 324 is formed in each longitudinal end of x-ray window frame and tabs 322 are received in respective notches 324 to prevent transverse movement of mattress support 264 relative to patient-support deck 254.

Patient-support deck 254 includes transversely spaced-apart first and second sides 326, 328 as shown in FIG. 11. X-ray tray 262 is supported by central portion 258 of patient-support deck 254 for sliding movement between a use position, shown in FIG. 14, and first and second load positions, shown in FIGS. 15 and 16, respectively. When x-ray tray 262 is in the use position, x-ray tray 262 is contained between first and second sides 326, 328 of patient-support deck. When x-ray tray is in the first load position, a portion of x-ray tray 262 extends beyond first side 326 of patient-support deck 254 and when x-ray tray is in the second load position a portion of x-ray tray 262 extends beyond second side 328 of patient-support deck.

Patient-support deck 254 includes a plurality of tabs 330 appended to tray-guiding walls 260 and arranged to overlie upper end surfaces 334 of x-ray tray 262 as shown in FIGS. 11 and 14–16. X-ray tray 262 includes end edges 332 that confront tray-guiding walls 260. X-ray tray 262 is positioned to lie between tray-guiding walls 260 so that engagement between end edges 332 of x-ray tray 262 and tray-guiding walls 260 limits the amount by which x-ray tray 262 can move longitudinally relative to patient-support deck 254. When x-ray tray 262 is in either of the first and second load positions, engagement between tabs 330 adjacent to respective first and second sides 326, 328 of patient-support deck 254 and upper surface 334 of x-ray tray 262 prevents x-ray tray 262 from tipping relative to patient-support deck 254.

Deck assembly 84 includes a link 336 that couples x-ray tray 262 to patient-support deck 254. X-ray tray 262 is formed to include a central aperture 338 and patient-support deck 254 is formed to include a slot 340 that extends between first and second sides 326, 328 of patient-support deck 254 along a "bell-shaped" path as shown in FIGS. 11 and 14–16. One end of slot 340 terminates at a first stop 342 formed in patient-support deck 254 adjacent to first side 326 and another end of slot 340 terminates at a second stop 344 formed in patient-support deck 254 adjacent to second side 326. Link 336 includes a downwardly-extending end disk 346 and an upwardly-extending end disk 348 as shown in FIG. 11. End disk 346 is received in slot 340 of patient-support deck 254 for sliding and pivoting movement and end disk 348 is received in aperture 338 of x-ray tray 262 for pivoting movement.

Figure 14:
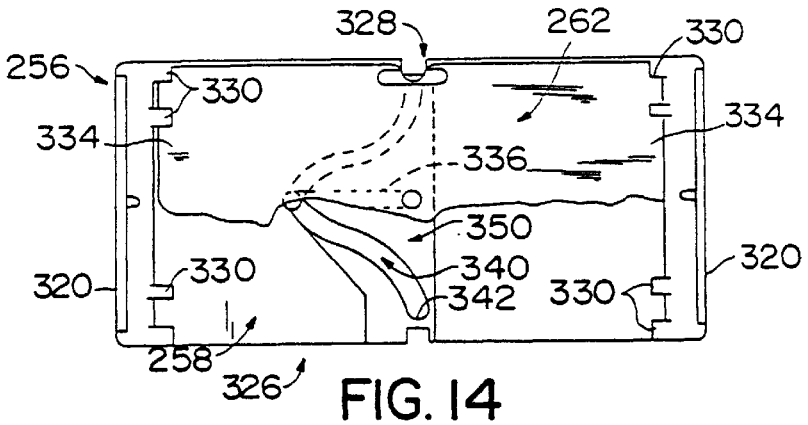
FIG. 14 is a top plan view of the patient-support deck and x-ray tray of FIG. 11, with portions broken away, showing the x-ray tray in a use position and the link in a longitudinally-extending position.
Figure 15:
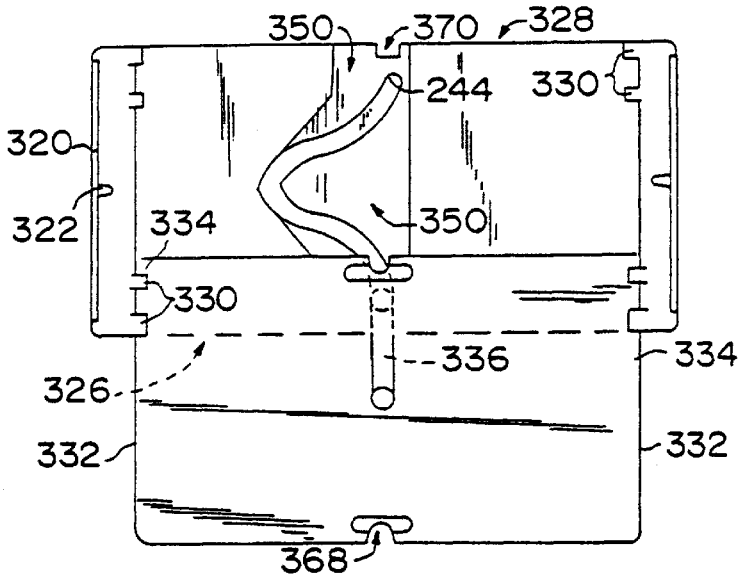
FIG. 15 is a top plan view similar to FIG. 14 showing the x-ray tray slid relative to the patient-support deck to a first load position and the link in a first transversely-extending position.
Figure 16:
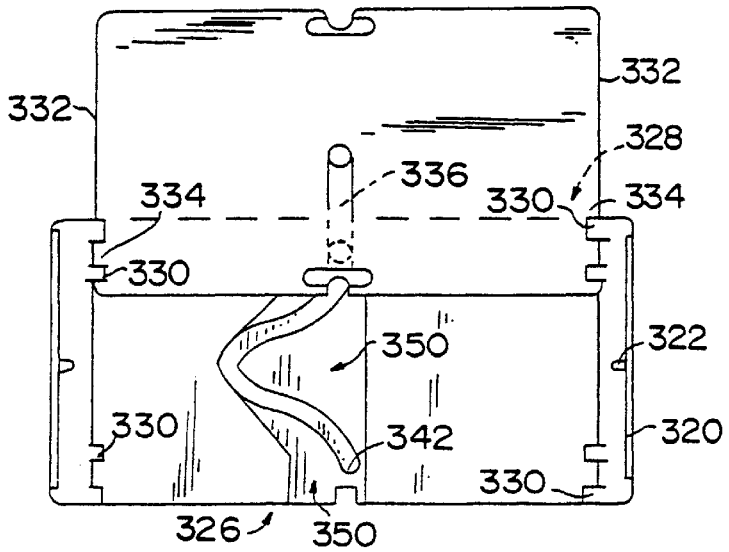
FIG. 16 is a top plan view similar to FIG. 15 showing the x-ray tray slid relative to the patient-support deck to a second load position and the link in a second transversely-extending position.

When x-ray tray 262 is in the use position, link 336 is in a longitudinally-extending position having end disk 346 longitudinally aligned with end disk 348 as shown in FIG. 14. In addition, end disk 346 is located at the apex of bell-shaped slot 340 and end disk 348 is transversely spaced apart from first and second stops 342, 344 equidistantly when x-ray tray 262 is in the use position. When x-ray tray 262 is in the first load position, end disk 346 engages first stop 342 to prevent x-ray tray 262 from moving away from patient-support deck 254 past the first load position as shown in FIG. 15. In addition, link 336 is in a first transversely-extending position having end disk 346 transversely aligned with end disk 348 when x-ray tray 262 is in the first load position. When x-ray tray 262 is in the second load position, end disk 346 engages second stop 344 to prevent x-ray tray 262 from moving away from patient-support deck 254 past the second load position as shown in FIG. 16. In addition, link 336 is in a second transversely-extending position having end disk 346 transversely aligned with end disk 348 when x-ray tray 262 is in the second load position.

First and second stops 342, 344 are formed in patient-support deck 254 so as to be transversely aligned with aperture 338 formed in x-ray tray 262. Thus, as x-ray tray is moved from the use position to the first load position, aperture 338 and end disk 348 pass over first stop 342 and as x-ray tray is moved from the use position to the second load position, aperture 338 and end disk 348 pass over second stop 344. In addition, link 336 pivots about one hundred eighty degrees (180°) relative to x-ray tray 262 as x-ray tray is moved between the first and second load positions. Central portion 258 of patient-support deck 254 is formed to include a link-receiving recess 350 in the region adjacent to slot 340 as shown in FIGS. 13–16. Link-receiving recess 350 is configured to make room for link 336 as link 336 pivots relative to x-ray tray 262 and slides relative to patient-support deck 254 during movement of x-ray tray 262 between the first and second load positions.

Link 336 is made out of a resilient material that allows link 336 to be flexed downwardly and away from x-ray tray 262 when x-ray tray 262 is in either of the first and second load positions. Flexing link 336 in this manner causes end disk 348 to be withdrawn from aperture 338 so that x-ray tray 262 can be moved transversely outwardly past the respective first or second load position and away from patient-support deck 254. When x-ray tray 262 is inserted back into the space between mattress support 264 and patient-support deck 254, link 336 can be flexed in the above-described manner and x-ray tray 262 can be slid back into place. Letting go of link 336 when aperture 338 is aligned with end disk 348, allows link 336 to unflex so that end disk 348 is returned back into aperture 338.

In use, a caregiver rotates knobs 99 to raise deck assembly 84 out of mattress well 82 of platform tub 30 so that x-ray tray 262 is accessible. The caregiver then slides x-ray tray 262 from the use position to either the first or the second load position, depending upon which side of patient-support apparatus 20 the caregiver is standing, and places a cassette of x-ray film 352, shown, for example, in FIGS. 11 and 17, on x-ray grid template 263. X-ray grid template 263 includes a set of lines that the caregiver can reference while positioning the cassette of x-ray film 352 on x-ray grid 263. X-ray tray 262 also includes a pair of handle recesses 351 that the caregiver can use to move the tray between the various positions. After the cassette of x-ray film 352 is at the desired position on x-ray grid template 263, the caregiver then slides x-ray tray 262 back into the use position so that the cassette of x-ray film 352 is positioned beneath the patient supported on mattress 276.

Figure 17:
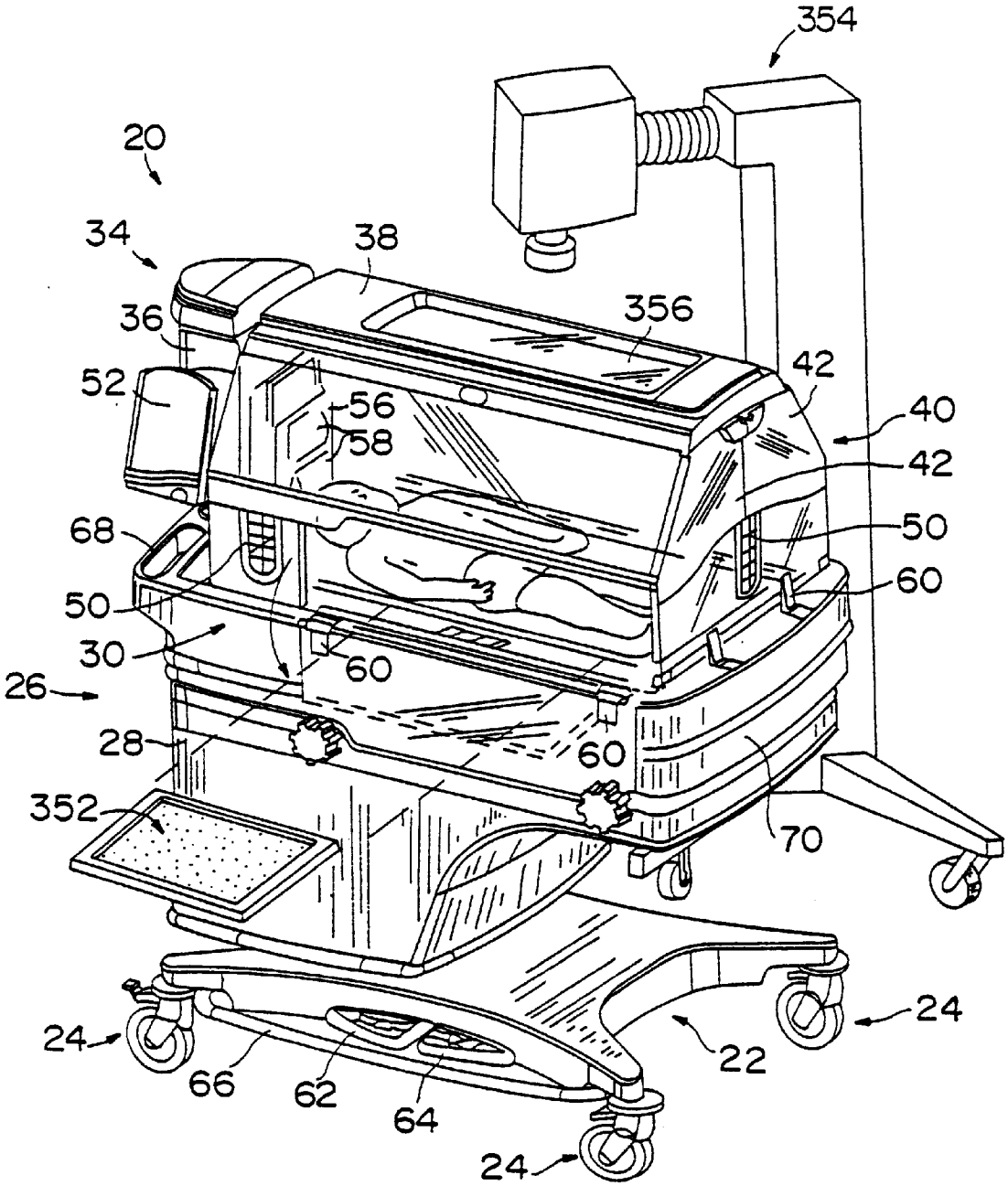
FIG. 17 is a perspective view of the thermal support apparatus of FIG. 1 showing the deck assembly moved to a raised position to provide a caregiver with access to the x-ray tray, the x-ray tray in the first load position (in phantom) so that the cassette of x-ray film can be loaded onto the x-ray tray, the x-ray tray in the use position (in solid), and an x-ray camera above an x-ray window supported by the canopy.

An x-ray device 354, shown in FIG. 17, is used to x-ray the patient supported on patient-support apparatus 20. An x-ray window 356 is carried by overhead portion 38 of canopy support arm 34. When x-rays of the patient are taken, the x-rays generated by x-ray device 354 pass through x-ray window 356, the patient, mattress 276, and x-ray window pane 268 of mattress support 264. After an x-ray of the patient is taken, x-ray tray 262 is moved from the use position into one of the first and second load positions and the cassette of x-ray film 352 is retrieved for developing. By providing patient-support apparatus 20 with components, such as x-ray tray 262, x-ray window 356, and x-ray window pane 268, there is no need to transfer the patient to another support device to have x-rays taken. Thus, x-rays can be taken of the patient supported by patient-support apparatus 20 with a minimal amount of disturbance to the patient.

In another use, a weight scale 358, shown in FIG. 11, is carried by x-ray tray 262 instead of the cassette of x-ray film 352. A preferred weigh scale 358 that is well-suited for use with patient-support assembly 20 is a Model No. 45225 weigh scale manufactured by Flintec located in Hudson, Mass. When weigh scale 358 is carried by x-ray tray 262, mattress support 264 is elevated slightly by weigh scale 358 so that ribs 269 are spaced apart from support surfaces 257 of end portions 256 of patient-support deck 254. Thus, the weight of mattress support 264, mattress 276, and the patient bears down on an upper surface 359 of weigh scale 358.

Weigh scale 358 includes a set of downwardly-extending support pads 360 and x-ray tray 262 is formed to include a set of pad recesses 362 that are adapted to receive support pads 360 when weigh scale 358 is carried by x-ray tray 262. Weigh scale 358 includes a plurality of load cells (not shown), an electrical connector 366, and a cable 364 coupling the load cells to connector 366. Electrical connector 366 attaches to an electrical system (not shown) of patient-support apparatus 20 so that weigh signals generated by each of the load cells can be processed by the electrical system to determine the weight of the patient carried by mattress 276. The electrical system of patient-support apparatus is configured so that the weight of the patient is accurately determined when deck assembly 84 is at any position between the Trendelenburg and reverse Trendelenburg positions.

X-ray tray 262 is formed to include a pair of cable notches 368 that extend inwardly from the sides of x-ray tray 262 through respective handle recesses 351. In addition, patient-support deck 254 is formed to include a pair of cable-loop troughs 370 and a set of cable grooves 372 along first and second sides 326, 328. When x-ray tray 262 is in the use position, cable notches 368 are aligned with cable-loop troughs 370 so that cable 364 can be routed from weigh scale 358, through one of cable notches 368, into one of cable-loop troughs 370, and through one of grooves 372. Routing cable 354 in this manner allows the elevation and inclination of deck assembly 84 to be adjusted without interference from cable 354.

Thus, according to the present invention, patient-support apparatus 20 includes a patient-support assembly 32 having a deck assembly 84 and a pair of elevation mechanisms 90 for moving ends 86, 88 of deck assembly 84. Each elevation mechanism includes first and second links 210, 212 coupled together at respective middle portions 218, a deck-engaging link 214 coupled to upper ends 216 of first and second links 210, 212 and arranged to support end 86, 88 of deck assembly 84, and a driver 95 coupled to lower ends 220 of first and second links 210, 212. Driver 95 is operable to move lower ends 220 of first and second links 210, 212 toward one another to raise deck-engaging link 214 and away from one another to lower deck-engaging link 214. Deck-engaging link 214 includes an upwardly-facing surface 288 and patient-support deck 254 includes a downwardly-facing surface 286 that engages upwardly-facing surface 288 to provide for pivoting and sliding movement of patient-support deck 254 relative to deck-engaging link 214. An x-ray tray 262 is coupled to patient-support deck 254 by a link 336. Patient-support deck 254 is formed to include first and second stops 342, 344. When link 336 engages first stop 342, x-ray tray 262 is in a first load position extending beyond first side 326 of patient-support deck 254, and when link 336 engages second stop 344, x-ray tray 262 is in a second load position extending beyond second side 328 of patient-support deck 254.

Although the invention has been described in detail with reference to a certain preferred embodiment, variations and modifications exist within the scope and spirit of the invention as described and as defined in the following claims.

What is claimed is:

1. A patient-support apparatus comprising a base, apatient-support assembly supported above the base, the patient-support assembly including a patient-support deck having longitudinally spaced-apart ends and an elevation mechanism for moving one of the ends of the patient-support deck relative to the other of the ends and relative to the base, the elevation mechanism including a transversely-extending threaded shaft, a pair of blocks threadedly coupled to the shaft, and a linkage coupled to the pair of blocks and extending upwardly therefrom to support the end of the patient support deck to be moved by the elevation mechanism, the pair of blocks moving transversely in response to rotation of the threaded shaft, and the linkage being configured to move the end of the patient-support deck relative to the base in response to transverse movement of the blocks, wherein a first portion of the threaded shaft is formed to include a right-handed thread, a second portion of the threaded shaft is formed to include a left-handed thread, one of the pair of blocks is coupled to the first portion of the threaded shaft, and the other of the pair of blocks is coupled to the second portion of the threaded shaft, and wherein each of the blocks of the pair of blocks includes a drive block portion and a nut plate formed to include a first aperture having a right-handed thread and a second aperture having a left-handed thread and the nut plates are coupled to the respective drive block portions to properly mate to the first and second portions of the threaded shaft.

2. A patient-support apparatus comprising a base, a patient-support assembly supported above the base, the patient-support assembly including a patient-support deck having longitudinally spaced-apart ends and an elevation mechanism for moving one of the ends of the patient-support deck relative to the other of the ends and relative to the base, the elevation mechanism including a transversely-extending threaded shaft, a pair of blocks threadedly coupled to the shaft, and a linkage coupled to the pair of blocks and extending upwardly therefrom to support the end of the patient support deck to be moved by the elevation mechanism, the pair of blocks moving transversely in response to rotation of the threaded shaft, and the linkage having horizontally extending pins drivingly connected to the patient support deck to move the end of the patient-support deck relative to the base in response to transverse movement of the blocks, and wherein the elevation mechanism includes a knob coupled to each end of the threaded shaft, and each knob includes a knob body and a fold-out crank handle coupled to the knob body for movement between a stored position and a use position in which the crank handle can be used to rotate the threaded shaft.

3. The patient-support apparatus of claim 2, wherein said each knob is axially movable relative to the threaded shaft, the elevation mechanism further includes a spring interposed between each knob and the threaded shaft, and each spring provides axial shock absorption between the knob and the threaded shaft.

4. The patient-support apparatus of claim 2, wherein the elevation mechanism further includes a spring coupled to the knob body and arranged to engage the crank handle to bias the crank handle into the stored position.

5. A patient-support apparatus comprising a base, a patient-support assembly supported above the base, the patient-support assembly including a patient-support deck having longitudinally spaced-apart ends and an elevation mechanism for moving one of the ends of the patient-support deck relative to the other of the ends and relative to the base, the elevation mechanism including a transversely-extending threaded shaft, a pair of blocks threadedly coupled to the shaft, and a linkage coupled to the pair of blocks and extending upwardly therefrom to support the end of the patient support deck to be moved by the elevation mechanism, the pair of blocks moving transversely in response to rotation of the threaded shaft, and the linkage having horizontally extending pins drivingly connected to the patient support deck to move the end of the patient-support deck relative to the base in response to transverse movement of the blocks, wherein the elevation mechanism further includes a base plate having an upwardly-facing surface and each block of said pair of blocks includes a downwardly-facing surface arranged to contact the upwardly-facing surface of the base plate in sliding bearing engagement, and wherein each of said blocks includes a pair of longitudinally spaced-apart guide lugs, the base plate is positioned to lie between the guide lugs, the base plate includes a pair of longitudinally spaced-apart transverse side edges extending downwardly from the upwardly-facing surface, and the side edges of the base plate cooperate with the guide lugs of the blocks to guide the transverse movement of the blocks.

6. A patient-support apparatus comprising a base, apatient-support assembly supported above the base, the patient-support assembly including a patient-support deck having longitudinally spaced-apart ends and an elevation mechanism for moving one of the ends of the patient-support deck relative to the other of the ends and relative to the base, the elevation mechanism including a transversely-extending threaded shaft, a pair of blocks threadedly coupled to the shaft, and a linkage coupled to the pair of blocks and extending upwardly therefrom to support the end of the patient support deck to be moved by the elevation mechanism, the pair of blocks moving transversely in response to rotation of the threaded shaft, and the linkage having horizontally extending pins drivingly connected to the patient support deck to move the end of the patient-support deck relative to the base in response to transverse movement of the blocks, wherein the elevation mechanism further includes a base plate having an upwardly-facing surface and each block of said pair of blocks includes a downwardly-facing surface arranged to contact the upwardly-facing surface of the base plate in sliding bearing engagement, and wherein the base plate is formed to include a pair of stop flanges, the pair of blocks are positioned to lie between the stop flanges, and the stop flanges limit the transverse movement of the blocks away from one another.

7. The patient-support apparatus of claim 6, wherein each stop flange of the pair of stop flanges includes a U-shaped edge defining a slot having an open upper end and a curved lower end, a portion of the threaded shaft is received in each of the slots, and the threaded shaft rotates relative to the base plate within the slots.

8. A patient-support apparatus comprising a base, a patient-support assembly supported above the base, the patient-support assembly including a patient-support deck having longitudinally spaced-apart ends and an elevation mechanism for moving one of the ends of the patient-support deck relative to the other of the ends and relative to the base, the elevation mechanism including a transversely-extending threaded shaft, a pair of blocks threadedly coupled to the shaft, and a linkage coupled to the pair of blocks and extending upwardly therefrom to support the end of the patient support deck to be moved by the elevation mechanism, the pair of blocks moving transversely in response to rotation of the threaded shaft, and the linkage having horizontally extending pins drivingly connected to the patient support deck to move the end of the patient-support deck relative to the base in response to transverse movement of the blocks, wherein the elevation mechanism further includes a base plate having an upwardly-facing surface and each block of said pair of blocks includes a downwardly-facing surface arranged to contact the upwardly-facing surface of the base plate in sliding bearing engagement, and wherein the base includes a platform, the elevation mechanism further includes at least one cap screw coupling the base plate to the platform, the cap screw includes a stop portion above the upwardly-facing surface of the base plate, and the stop portion limits the transverse movement of the blocks toward one another.

9. A patient-support apparatus comprising a base, a patient-support assembly supported above the base, the patient-support assembly including a patient-support deck having longitudinally spaced-apart ends and an elevation mechanism for moving one of the ends of the patient-support deck relative to the other of the ends and relative to the base, the elevation mechanism including a transversely-extending threaded shaft, a pair of blocks threadedly coupled to the shaft, and a linkage coupled to the pair of blocks and extending upwardly therefrom to support the end of the patient support deck to be moved by the elevation mechanism, the pair of blocks moving transversely in response to rotation of the threaded shaft, and the linkage having horizontally extending pins drivingly connected to the patient support deck to move the end of the patient-support deck relative to the base in response to transverse movement of the blocks, and wherein the elevation mechanism further includes a spring lift assembly having a member coupled to the linkage and a spring coupled to the base and wherein the member compresses the spring when the blocks are moved to lower the end of the patient-support deck to be moved by the elevation mechanism.

10. A patient-support apparatus comprising a base, a patient-support assembly supported above the base, the patient-support assembly including a patient-support deck having longitudinally spaced-apart ends and an elevation mechanism for moving one of the ends of the patient-support deck relative to the other of the ends and relative to the base, the elevation mechanism including a first link, a second link, a deck-engaging link, and a driver, each of the first and second links including a lower end, an upper end, and a middle portion between the upper and lower ends, the middle portion of the first link being pivotably coupled to the middle portion of the second link, the deck-engaging link being coupled to the first and second links by horizontal extending pins and arranged to support the end of the patient-support deck to be moved by the elevation mechanism, the lower ends of the first and second links being coupled to the driver, the driver being operable to simultaneously move the lower ends of the first and second links toward one another to raise the deck-engaging link, and the driver being operable to simultaneously move the lower ends of the first and second links away from one another to lower the deck-engaging link, and wherein the elevation mechanism further includes a spring lift assembly having a member coupled to the first and second links and a spring coupled to the base, the member compresses the spring when the first and second links are moved toward one another, and the spring acts between the member and the base to resist lowering of the deck-engaging link.

11. A patient-support apparatus comprising a base, a patient-support assembly supported above the base, the patient-support assembly including a patient-support deck having longitudinally spaced-apart ends and an elevation mechanism for moving one of the ends of the patient-support deck relative to the other of the ends and relative to the base, the elevation mechanism including a first link, a second link, a deck-engaging link, and a driver, each of the first and second links including a lower end, an upper end, and a middle portion between the upper and lower ends, the middle portion of the first link being pivotably coupled to the middle portion of the second link, the deck-engaging link being arranged to support the end of the patient-support deck to be moved by the elevation mechanism, the first and second links being coupled to the driver, the driver being operable to move the first and second links, the deck engaging link being formed to include a first slot and a second slot, the elevation mechanism further including a first pin received in the first slot and coupled to the upper end of the first link and a second pin received in the second slot and coupled to the upper end of the second link, the first and second pins moving within the respective first and second slots as the first and second links move, and wherein the elevation mechanism further includes a spring lift assembly having a member coupled to the first and second links and a spring coupled to the base, the member compresses the spring when the driver moves the first and second links to lower the deck-engaging link relative to the base, and the spring acts between the member and the base to resist lowering of the deck-engaging link.

12. A patient-support apparatus comprising a base, and a patient-support assembly supported above the base, the patient-support assembly including a patient support deck having longitudinally spaced-apart ends, the patient-support assembly including an elevation mechanism operable to raise and lower one of the ends of the patient-support deck relative to the other of the ends and relative to the base, the elevation mechanism including a deck-engaging link having an upwardly-facing surface, the patient-support deck being formed to include a downwardly-facing surface, the downwardly-facing surface extending in parallelism with the spaced apart ends and engaging the upwardly-facing surface of the deck-engaging link to provide for pivoting and sliding of the downwardly facing surface relative to the upwardly-facing surface as a consequence of the raising and lowering of the one end of the patient support deck where the pivoting is about an axis extending longitudinally of the patient support deck and the sliding is in transverse direction with respect to the support deck.

13. A patient-support apparatus comprising a base, a patient-support assembly supported above the base, the patient-support assembly including a patient-support deck having longitudinally spaced-apart ends, the patient-support assembly including an elevation mechanism operable to raise and lower one of the ends of the patient-support deck relative to the other of the ends and relative to the base, the elevation mechanism including a deck-engaging link having an upwardly-facing surface, the patient-support deck being formed to include a downwardly-facing surface, the downwardly-facing surface engaging the upwardly-facing surface of the deck-engaging link to provide for pivoting and sliding relative to the upwardly-facing surface, and wherein the patient-support deck includes first and second sides transversely spaced apart by a first distance with a rib extending downwardly and transversely between the sides to provide the downwardly-facing surface and the deck-engaging link includes first and second ends spaced apart by approximately the first distance.

14. The patient-support apparatus of claim 13, wherein the downwardly-facing surface is convex.

15. A patient-support apparatus comprising a base, a patient-support assembly supported above the base, the patient-support assembly including a patient-support deck having longitudinally spaced-apart ends, the patient-support assembly including an elevation mechanism operable to raise and lower one of the ends of the patient-support deck relative to the other of the ends and relative to the base, the elevation mechanism including a deck-engaging link having an upwardly-facing surface, the patient-support deck being formed to include a downwardly-facing surface, the downwardly-facing surface engaging the upwardly-facing surface of the deck-engaging link to provide for pivoting and sliding relative to the upwardly-facing surface, and wherein the deck-engaging link includes an outer transverse rim extending upwardly from the upwardly-facing surface, the deck-engaging link includes a transverse lip extending upwardly from the upwardly-facing surface in spaced-apart relation with the transverse rim, and a rib is positioned to lie between the transverse rim and the transverse lip.

16. The patient-support apparatus of claim 15, wherein the deck-engaging link includes a first end rim connecting the transverse rim to the transverse lip adjacent to the first side of the patient-support deck, the deck-engaging link includes a second end rim connecting the transverse rim to the transverse lip adjacent to the second side of the patient-support deck, and said rib is positioned to lie between the first end rim and the second end rim.

17. A patient-support apparatus comprising a base, a patient-support assembly supported above the base, the patient-support assembly including a patient-support deck having longitudinally spaced-apart ends, the patient-support assembly including an elevation mechanism operable to raise and lower one of the ends of the patient-support deck relative to the other of the ends and relative to the base, the elevation mechanism including a deck-engaging link having an upwardly-facing surface, the patient-support deck being formed to include a downwardly-facing surface, the downwardly-facing surface engaging the upwardly-facing surface of the deck-engaging link to provide for pivoting and sliding relative to the upwardly-facing surface, and wherein the deck-engaging link includes a downwardly-facing bottom surface and the patient-support assembly further includes a retainer coupled to the patient-support deck and arranged to engage the bottom surface of the deck- engaging link to prevent separation of the patient-support deck and the deck-engaging link.

18. The patient-support apparatus of claim 17, wherein the retainer includes a curved portion having an upwardly-facing convex surface, the upwardly-facing convex surface of the retainer engages the downwardly-facing bottom surface of the deck-engaging link, and the upwardly-facing convex surface of the retainer pivots and slides relative to the downwardly-facing bottom surface of the deck-engaging link as the elevation mechanism moves the patient-support deck.

19. The patient-support apparatus of claim 18, wherein the upwardly-facing convex surface of the retainer is horizontally and vertically offset from the downwardly facing convex surface of the deck-engaging link.

20. A patient-support apparatus comprising a base, a patient-support assembly supported above the base, the patient-support assembly including a patient-support deck having longitudinally spaced-apart ends, the patient-support assembly including an elevation mechanism operable to raise and lower one of the ends of the patient-support deck relative to the other of the ends and relative to the base, the elevation mechanism including a deck-engaging link having an upwardly-facing surface, the patient-support deck being formed to include a downwardly-facing surface, the downwardly-facing surface engaging the upwardly-facing surface of the deck-engaging link to provide for pivoting and sliding relative to the upwardly-facing surface, and wherein the deck-engaging link includes a downwardly-facing bottom surface and the patient-support assembly further includes a retainer coupled to the patient-support deck for pivoting movement between a first position engaging the bottom surface of the deck-engaging link to prevent separation of the patient-support deck and the deck-engaging link and a second position spaced-apart from the bottom surface of the deck-engaging link to allow separation of the patient-support deck and the deck-engaging link.

21. The patient-support apparatus of claim 20, wherein the retainer includes a curved portion having an upwardly-facing convex surface, the upwardly-facing convex surface of the retainer engages the downwardly-facing bottom surface of the deck-engaging link when the retainer is in the first position, and the upwardly-facing convex surface of the retainer is spaced apart from the downwardly-facing bottom surface of the deck-engaging link when the retainer is in the second position.

22. The patient-support apparatus of claim 21, wherein the upwardly-facing convex surface of the retainer is horizontally and vertically offset from the downwardly facing convex surface of the deck-engaging link.

23. The patient-support apparatus of claim 21, wherein the deck-engaging link includes an edge extending between the upwardly-facing surface and the downwardly-facing bottom surface, the edge is formed to include a notch, and the curved portion of the retainer is aligned with the notch when the retainer is in the second position.

24. A patient-support apparatus comprising a base, a platform supported above the base, and a patient-support assembly supported above the platform, the patient-support assembly including a patient-support deck having longitudinally spaced-apart ends and an elevation mechanism for moving one of the ends of the patient-support deck relative to the other of the ends and relative to the base, the elevation mechanism including a scissors linkage having at least first and second links coupled to the patient-support deck, a pivot pin coupling the first and second links together for pivoting movement, a driver configured to actuate the first and second links to move the patient-support deck, and a spring lift assembly having a member coupled to the pivot pin and a spring supported by the platform, the member compressing the spring when the first and second links are actuated to lower the end of the patient-support deck to be moved by the elevation mechanism.

25. The patient-support apparatus of claim 24, wherein the member includes a horizontal plate, the spring includes a top end, and the plate engages the top end of the spring to compress the spring.

26. The patient-support apparatus of claim 25, wherein the spring lift assembly further includes a spring guide coupled to the horizontal plate, the spring is a coiled spring having an interior region, and the spring guide extends downwardly from the horizontal plate into the interior region.

27. The patient-support apparatus of claim 26, wherein the spring lift assembly further includes a stud extending upwardly from the platform into the interior region of the spring, the spring guide is formed to include a stud-receiving bore, and a portion of the stud is received in the stud-receiving bore when the first and second links are actuated to lower the end of the patient-support deck to be moved by the elevation mechanism.

28. The patient-support apparatus of claim 25, wherein the horizontal plate is spaced apart from the top end of the spring when the elevation mechanism is in a raised position.

29. The patient-support apparatus of claim 25, wherein the spring lift assembly member includes a vertical plate coupled to the pivot pin and the horizontal plate is appended to the vertical plate.

30. The patient-support apparatus of claim 24, wherein the spring lift assembly further includes a spring guide coupled to the member, the spring is a coiled spring having an interior region, and the spring guide extends downwardly from the member into the interior region.

31. The patient-support apparatus of claim 30, wherein the spring lift assembly further includes a stud extending upwardly from the platform into the interior region of the spring, the spring guide is formed to include a stud-receiving bore, and a portion of the stud is received in the stud-receiving bore when the first and second links are actuated to lower the end of the patient-support deck to be moved by the elevation mechanism.

32. The patient-support apparatus of claim 24, wherein the spring is a vertically oriented coiled compression spring.

33. A patient-support apparatus comprising:

a base, a patient-support deck, and an elevation mechanism operable to raise and lower the patient-support deck relative to the base, the elevation mechanism including a spring lift assembly that operates to resist lowering of the patient-support deck.

34. The patient-support apparatus of claim 24, wherein the spring lift assembly includes a member and a spring coupled to the base, the member compressing the spring when the patient-support deck is lowered.

* * * * *